US008627604B2

(12) United States Patent
Seymour et al.

(10) Patent No.: US 8,627,604 B2
(45) Date of Patent: Jan. 14, 2014

(54) BYPASS DOOR

(75) Inventors: Daniel R. Seymour, Plainville, CT (US); Vito A. Spinelli, Shelton, CT (US); Thomas M. Kowalczyk, Unionville, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 0 days.

(21) Appl. No.: 13/217,129

(22) Filed: Aug. 24, 2011

(65) Prior Publication Data

US 2012/0159851 A1 Jun. 28, 2012

Related U.S. Application Data

(60) Provisional application No. 61/426,936, filed on Dec. 23, 2010.

(51) Int. Cl.

| | |
|---|---|
| ***E06B 3/50*** | (2006.01) |
| ***E05F 11/54*** | (2006.01) |
| ***E05D 15/08*** | (2006.01) |

(52) U.S. Cl.

USPC ..... 49/141; 49/125; 49/149; 49/158

(58) Field of Classification Search

USPC ..... 49/149, 141, 158, 159, 160, 161, 162, 49/172, 173, 174, 175, 176, 177, 178, 180, 49/188, 190

See application file for complete search history.

(56) References Cited

U.S. PATENT DOCUMENTS

| | | | | | |
|---|---|---|---|---|---|
| 500,760 | A | * | 7/1893 | Gerhardt | 16/207 |
| 704,887 | A | * | 7/1902 | Low | 49/73.1 |
| 971,261 | A | * | 9/1910 | Frisbee | 49/316 |
| 1,183,052 | A | * | 5/1916 | Warren | 49/157 |
| 1,852,608 | A | * | 4/1932 | Grable | 160/211 |
| 2,122,182 | A | * | 6/1938 | Rogers | 49/175 |
| 2,185,888 | A | * | 1/1940 | Donahoe | 49/185 |
| 2,373,023 | A | * | 4/1945 | Goodwin | 49/102 |
| 3,025,574 | A | * | 3/1962 | Finkel | 49/177 |
| 3,224,046 | A | * | 12/1965 | Walters | 49/70 |
| 3,300,897 | A | | 1/1967 | Wikkerink | |
| 3,318,047 | A | | 5/1967 | Carson | |

(Continued)

FOREIGN PATENT DOCUMENTS

| | | |
|---|---|---|
| CA | 2464637 | 10/2004 |
| JP | 2008-095285 | 4/2008 |

(Continued)

*Primary Examiner* — Katherine Mitchell

*Assistant Examiner* — Justin Rephann

(74) *Attorney, Agent, or Firm* — Richard J. Veltman; Adan Ayala

(57) ABSTRACT

A door assembly that includes a normally fixed door panel disposed between an ingress opening and an egress opening. The door assembly includes a first sliding door panel slidable between a 1) closed position wherein the first sliding door panel blocks the ingress opening and 2) an open position wherein the first sliding door panel is in an overlapping configuration with the normally fixed door panel so as to permit persons to egress through the egress opening. A second sliding door panel is slidable between a 1) closed position wherein the second sliding door panel blocks the egress opening and 2) an open position wherein the second sliding door panel is in an overlapping configuration with the normally fixed door panel so as to permit persons to ingress through the ingress opening. The normally fixed door panel is pivotable to a breakout open position upon receiving a pivoting actuation.

21 Claims, 20 Drawing Sheets

(56) References Cited

U.S. PATENT DOCUMENTS

| | | | | | |
|---|---|---|---|---|---|
| 3,354,581 | A | | 11/1967 | Dimmitt et al. | |
| 3,466,805 | A | | 9/1969 | Muessel | |
| 3,491,483 | A | | 1/1970 | Miller | |
| 4,305,227 | A | | 12/1981 | Georgelin | |
| 4,337,597 | A | * | 7/1982 | Struckmeyer | 49/256 |
| 4,475,311 | A | * | 10/1984 | Gibson | 49/176 |
| 4,503,637 | A | | 3/1985 | Parente | |
| 4,619,074 | A | | 10/1986 | Leung et al. | |
| 4,646,471 | A | * | 3/1987 | Shaiu | 49/231 |
| 5,168,665 | A | * | 12/1992 | Goldenberg | 49/172 |
| 5,423,144 | A | * | 6/1995 | Santos | 49/189 |
| 5,486,026 | A | * | 1/1996 | Borgardt | 292/71 |
| 5,832,980 | A | | 11/1998 | Cianciolo | |
| 6,058,665 | A | * | 5/2000 | Halvorson et al. | 52/205 |
| 6,061,961 | A | | 5/2000 | Rupe | |
| 6,170,195 | B1 | | 1/2001 | Lim | |
| 6,276,092 | B1 | * | 8/2001 | Neo | 49/183 |
| 6,422,287 | B1 | | 7/2002 | Wilke | |
| 6,526,695 | B1 | | 3/2003 | Nguyen | |
| 6,973,753 | B2 | | 12/2005 | Liebscher | |
| 7,024,821 | B2 | * | 4/2006 | Lu | 49/177 |
| 7,117,637 | B2 | | 10/2006 | Delgado et al. | |
| 7,222,457 | B2 | | 5/2007 | Delgado et al. | |
| 7,254,918 | B2 | | 8/2007 | Fronz et al. | |
| 7,296,608 | B2 | | 11/2007 | Weishar et al. | |
| 7,451,802 | B2 | | 11/2008 | Cianciolo et al. | |
| 7,458,410 | B1 | * | 12/2008 | Bronner | 160/197 |
| 7,565,770 | B2 | | 7/2009 | Delgado et al. | |
| 7,950,439 | B2 | * | 5/2011 | Anderson | 160/211 |
| 8,096,342 | B2 | * | 1/2012 | Scruggs | 160/211 |
| 2004/0025455 | A1 | | 2/2004 | Nubel et al. | |
| 2004/0049984 | A1 | * | 3/2004 | Pfaff | 49/116 |
| 2006/0150512 | A1 | | 7/2006 | Heithe et al. | |
| 2007/0119548 | A1 | * | 5/2007 | Anderson | 160/211 |
| 2007/0144070 | A1 | | 6/2007 | Delgado et al. | |
| 2007/0169899 | A1 | * | 7/2007 | Cianciolo et al. | 160/211 |
| 2008/0250716 | A1 | | 10/2008 | Ranaudo et al. | |
| 2009/0000199 | A1 | | 1/2009 | Huynh et al. | |
| 2009/0235589 | A1 | | 9/2009 | Davis et al. | |
| 2010/0024160 | A1 | | 2/2010 | Kuchas | |
| 2010/0242366 | A1 | | 9/2010 | Liebscher et al. | |
| 2011/0214350 | A1 | * | 9/2011 | Salvietti et al. | 49/129 |
| 2012/0073205 | A1 | * | 3/2012 | Hamaker et al. | 49/163 |
| 2012/0255230 | A1 | * | 10/2012 | Smith et al. | 49/257 |

FOREIGN PATENT DOCUMENTS

| | | |
|---|---|---|
| JP | 2008-180063 | 8/2008 |
| JP | 2008-180064 | 8/2008 |
| JP | 2008-180065 | 8/2008 |
| JP | 2008-180066 | 8/2008 |
| WO | WO 01/07742 | 2/2001 |
| WO | WO 03/052226 | 6/2003 |
| WO | WO 2004/079133 | 9/2004 |

* cited by examiner

BYPASS DOOR

CROSS-REFERENCE TO RELATED APPLICATIONS

The present application claims the benefit of priority from U.S. Provisional Patent Application No. 61/426,936, filed on Dec. 23, 2010, the content of which is incorporated herein by reference in its entirety.

BACKGROUND OF THE INVENTION

1. Field of the Invention

The present invention relates to a sliding door assembly that includes a normally fixed door panel, sliding door panels, and breakaway features that enables the sliding door panels and/or the normally fixed door panel to move to a breakaway configuration.

2. Background of the Invention

Bypass door assemblies generally include a frame assembly with at least one fixed or non-sliding door panel mounted between sliding door panels that move in a generally rectilinear manner between opened and closed positions. The door assemblies are installed in many environments (e.g., in commercial buildings) where the sliding door panels are configured to automatically slide open and close in order to provide easy access to premises and avoid congestion in high traffic environments.

Oftentimes, the sliding door panels, when slid into the closed position, are provided with the capability to open outwardly in a swinging manner under an application of a force (e.g., manual force) to allow persons to pass through the door assembly during certain conditions (e.g., if the door operator is unable to open the sliding door panel(s)). This capability, referred to in the art as "breakout" or "breakaway," is often required by state or local building codes as a measure for facilitating exit from buildings in certain situations. This breakaway feature permits the door panels to be pivotally swung open about a pivot axis.

The normally fixed, non-sliding door panel of a bypass door assembly is typically incapable of being pivoted to the breakaway position. Furthermore, the sliding door panel and the non-sliding door panel are typically arranged such that the pivoting action of each of the sliding door panels is permitted only when each sliding door panel is fully in the closed position.

The present invention provides several improvements over the prior art.

SUMMARY OF THE INVENTION

One aspect of the present invention provides a door assembly configured to permit or prevent passage between a first side and a second side, the door assembly includes a normally fixed door panel having a normally closed position. The normally fixed door panel is disposed between an ingress opening and an egress opening. The door assembly further includes a first sliding door panel that is slidable between a 1) closed position wherein the first sliding door panel blocks the egress opening and 2) an open position wherein the first sliding door panel is in an overlapping configuration with the normally fixed door panel so as to permit persons to egress through the egress opening. The door assembly also includes a second sliding door panel that is slidable between a 1) closed position wherein the second sliding door panel blocks the ingress opening and 2) an open position wherein the second sliding door panel is in an overlapping configuration with the normally fixed door panel so as to permit persons to ingress through the ingress opening. The normally fixed door panel is pivotable to a breakout open position upon receiving a pivoting actuation.

Another aspect provides a door assembly configured to permit or prevent passage between a first side and a second side, the door assembly includes a normally fixed door panel having a normally closed position. The normally fixed door panel is disposed between an ingress opening and an egress opening. The door assembly further includes a first sliding door panel that is slidable between a 1) closed position wherein the first sliding door panel blocks the egress opening and 2) an open position wherein the first sliding door panel is in an overlapping configuration with the normally fixed door panel so as to permit persons to egress through the egress opening. The door assembly also includes a second sliding door panel that is slidable between a 1) closed position wherein the second sliding door panel blocks the ingress opening and 2) an open position wherein the second sliding door panel is in an overlapping configuration with the normally fixed door panel so as to permit persons to ingress through the ingress opening. The first sliding door panel and the second sliding door panel can be pivoted to a breakout open position when in an open or partially open sliding position.

These and other aspects of the present invention, as well as the methods of operation and functions of the related elements of structure and the combination of parts and economies of manufacture, will become more apparent upon consideration of the following description and the appended claims with reference to the accompanying drawings, all of which Run a part of this specification, wherein like reference numerals designate corresponding parts in the various figures. In one embodiment of the invention, the structural components illustrated can be considered are drawn to scale. It is to be expressly understood, however, that the drawings are for the purpose of illustration and description only and are not intended as a definition of the limits of the invention. It shall also be appreciated that the features of one embodiment disclosed herein can be used in other embodiments disclosed herein. As used in the specification and in the claims, the singular form of "a", "an", and "the" include plural referents unless the context clearly dictates otherwise.

DETAILED DESCRIPTION OF THE INVENTION

Figure 1A:
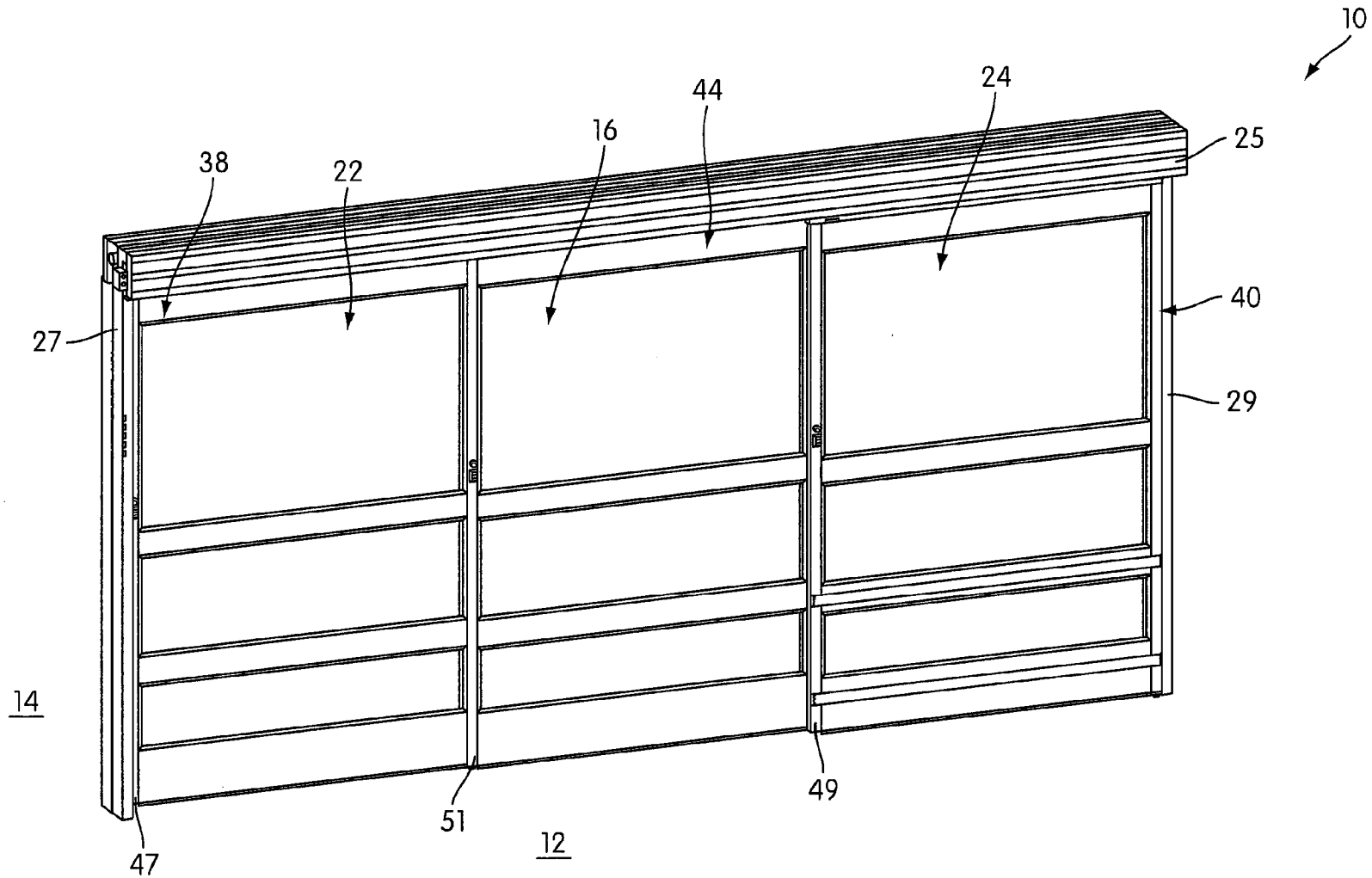
FIG. 1A is a perspective view of a door assembly in a closed position in accordance with an embodiment.

FIG. 1*a* shows a door assembly 10 configured to permit or prevent passage between a first side 12 (e.g., the outside) and a second side 14 (e.g., the inside). The door assembly 10 includes a normally fixed door panel 16 having a normally closed position. The normally fixed door panel 16 is disposed between an egress opening 18 (see FIGS. 2A-2B) and an ingress opening 20 (see FIGS. 2A-2B). The door assembly 10 also includes a first sliding door panel 22 that is slidable between a 1) closed position wherein the first sliding door panel 22 blocks the egress opening 18 (see FIGS. 1A-1B) and 2) an open position wherein the first sliding door panel 22 is in an overlapping configuration with the normally fixed door panel 16 so as to permit persons to egress through the egress opening 18 (see FIGS. 2A-2B). The door assembly also includes a second sliding door panel 24 that is slidable between a 1) closed position wherein the second sliding door panel blocks the ingress opening 20 (see FIG. 1A) and 2) an open position wherein the second sliding door panel 24 is in an overlapping configuration with the normally fixed door panel 16 so as to permit persons to ingress through the ingress opening 20 (see FIG. 2A). The normally fixed door panel 16 is pivotable to a breakout open position (see FIG. 3) upon receiving a pivoting actuation. The first and second sliding door panels 22, 24 are each also pivotable to a breakout open configuration upon receiving a pivoting actuation, as shown in FIG. 3.

Referring back to the embodiment shown in FIG. 1A, the door assembly 10 includes a header 25 constructed and arranged to be mounted with respect to an opening formed, for example, through a wall (not shown) or barrier to which the door assembly 10 is installed. The header 25 may be made of aluminum, plastic, wood, other materials, or any combination thereof. First and second opposing door jambs 27, 29 extend generally perpendicular to the header 25 towards a lower surface (e.g., floor). The normally fixed door panel 16 is normally fixed between the opposing door jambs 27, 29 and the sliding door panels 22, 24 are constructed and arranged to slide between the open and closed positions between the opposing door jambs 27, 29. The header 25 may be formed from separate first and second header components 31, 33 (see FIG. 6) associated with sliding doors 22, 24, respectively, or may be a single component associated with the sliding doors 22, 24, and the normally fixed door panel 16. In one embodiment, the sliding door panel 22 and the normally fixed door panel 16 may be associated with the second header component 33 and the second sliding door panel 24 may be associated with the first header component 31. However, it is contemplated that the number of headers components and arrangement of the door panels 16, 22, 24 with the header component(s) may vary in other embodiments.

Each sliding door panel 22, 24 includes a frame 38, 40, respectively. A sheet of material, such as glass, plastic, or a combination thereof may be provided in the frames 38, 40 to form the sliding door panels 22, 24. The frame 38 of the sliding door panel 22 may include a pivot stile 46 and a leading stile 47 (see FIG. 3). Similarly, the frame 40 of the second sliding door panel 24 may include a pivot stile 48 and a leading stile 49. The normally fixed door panel 16 may also include a frame 44. The frame 44 may include a pivot stile 50 and a leading stile 51. A sheet of material, such as such as glass, plastic, or a combination thereof may be provided in the frame 44 to form the normally fixed door panel 16. The frames 38, 40, 44 may be made of metal material (e.g., steel or aluminum), a wood material, other materials, or a combination thereof. In one embodiment, the door frames 38, 40, 44 may have hollow construction to permit the introduction and housing of electrical leads or connections.

Figure 3:
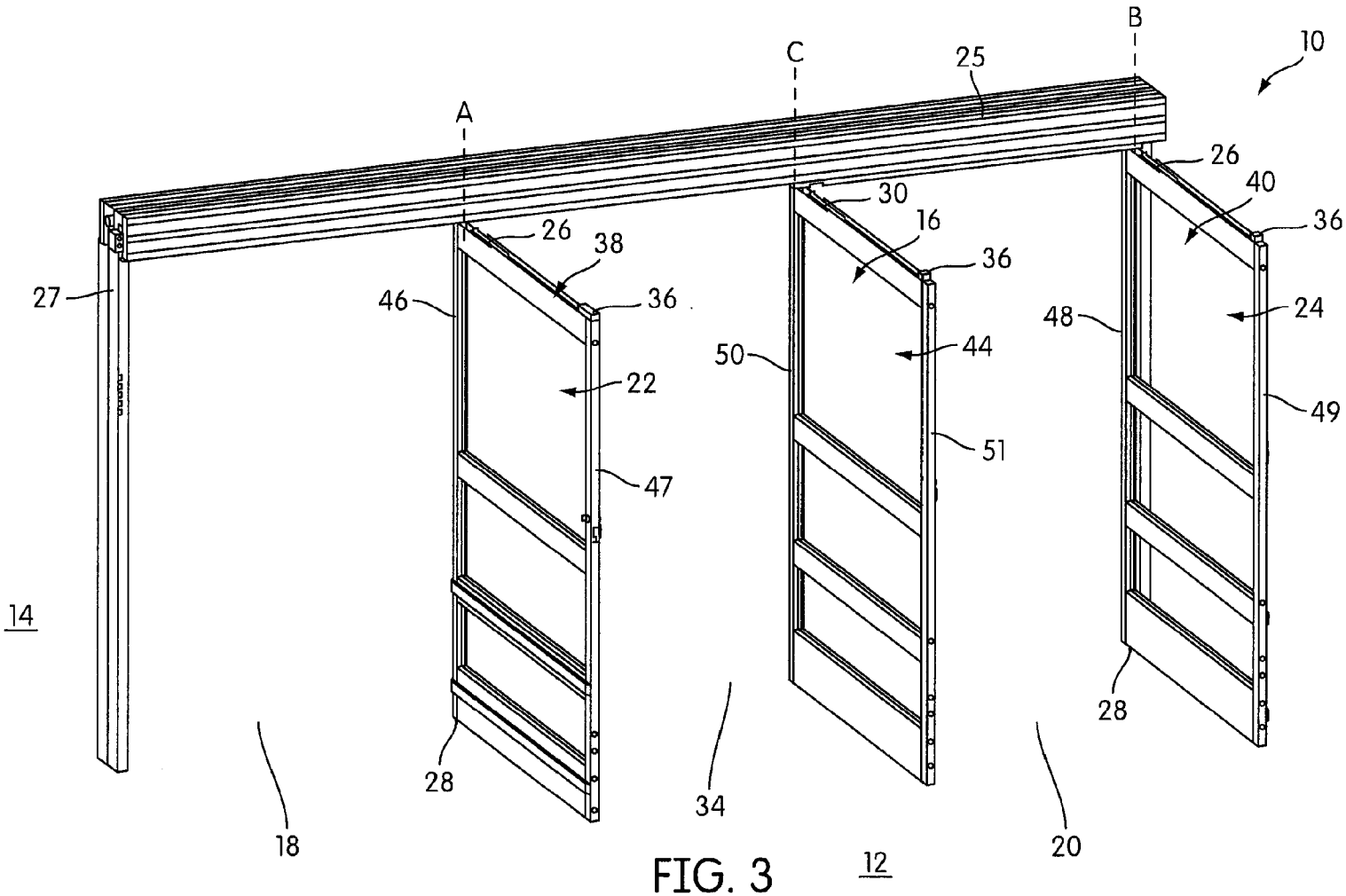
FIG. 3 is a perspective view of the door assembly with a normally fixed door panel and first and second sliding panels pivoted to a breakaway configuration from the position shown in FIG. 1A.
Figure 7:
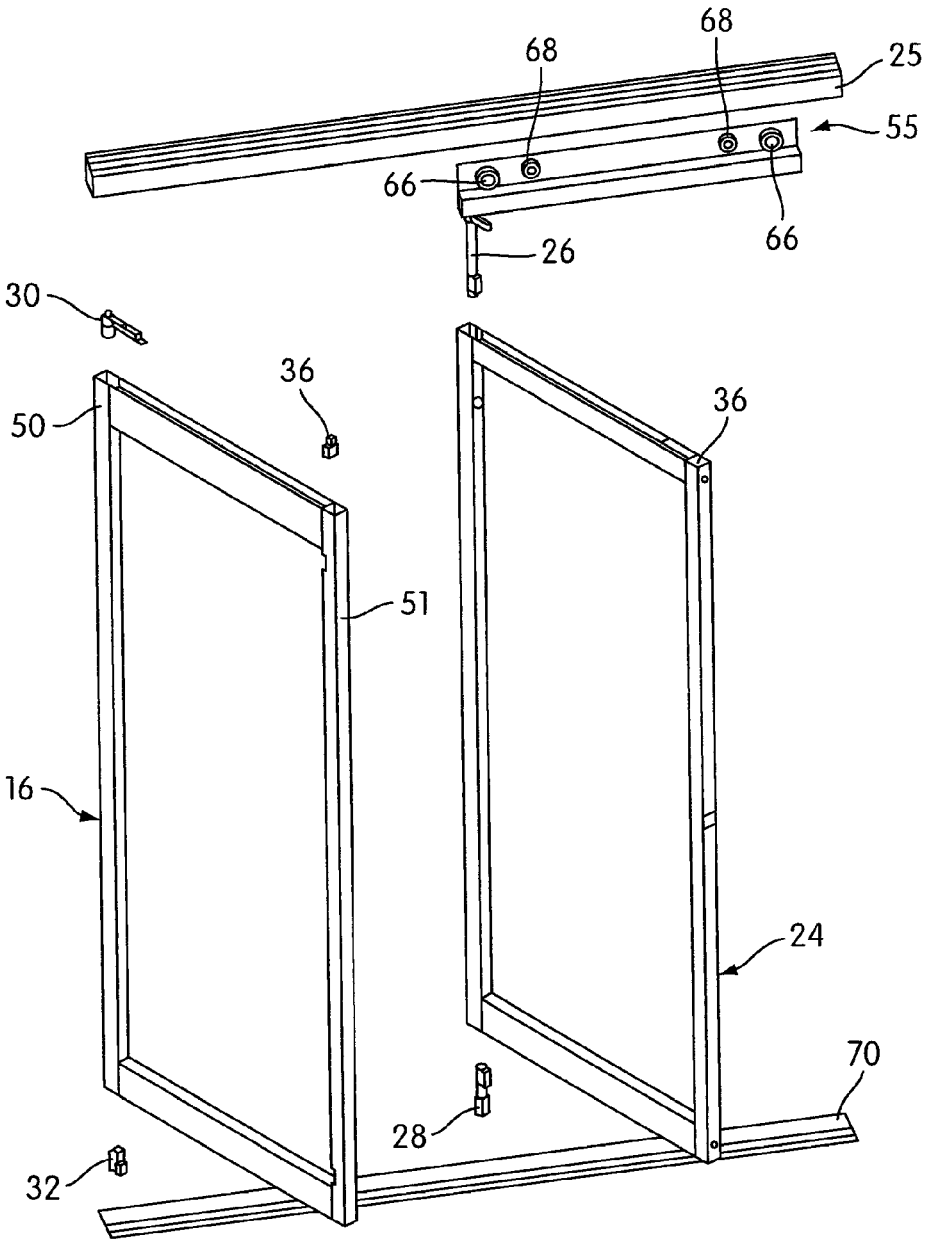
FIG. 7 is an exploded view of the normally fixed door panel and the second sliding door panel of the door assembly.

In the embodiment shown in FIG. 3, each sliding door panel 22, 24 includes an upper pivot mechanism 26 and a lower pivot mechanism 28. The pivot mechanisms 26, 28 are constructed and arranged to enable pivotal movement of the first and second sliding door panels about pivot axes A, B, respectively, from 1) a normal configuration wherein the door panels 22, 24 cover the openings 18, 20 when in the closed position to 2) a breakout configuration wherein the sliding door panels are pivoted away from the normal configuration. The pivot mechanisms 26, 28 may be located on pivot stiles 46, 48 of the sliding door panels 22, 24, respectively. The normally fixed door panel 16 may also be provided with an upper pivot mechanism 30 and a lower pivot mechanism 32 (see FIG. 7). The pivot mechanisms 30, 32 may be constructed and arranged to enable pivotal movement of the normally fixed door panel 16 about pivot axis C (see FIG. 3) from a normal configuration wherein the normally fixed door panel 16 covers a center opening 34 (see FIG. 3) located between the egress and ingress openings 18, 20 to a breakout configuration wherein the normally fixed door panel 16 is pivoted away from the normal configuration, thus exposing the opening 34. As shown in FIG. 7, the pivot mechanisms 30, 32 may be provided on the pivot stile 50 of the normally fixed door panel 16. Accordingly, when viewing the door assembly 10 from the first side 12 (e.g., the outside) as shown in FIG. 3, the pivot axes A, B, C are located on a right side of each of the normally fixed door panel 16 and the sliding door panels 22, 24. However, it is contemplated that in other embodiments, the pivot axes A, B, C, may be located on the other side (i.e., the left side).

Each door panel 16, 22, and 24 may be provided with a lock arrangement 36 constructed and arranged to releasably lock the door panels 16, 22, 24 to prevent pivotal movement of the door panels 16, 22, 24 away from the normal configuration. The lock arrangement 36 will be described in more detail below.

Figure 1B:
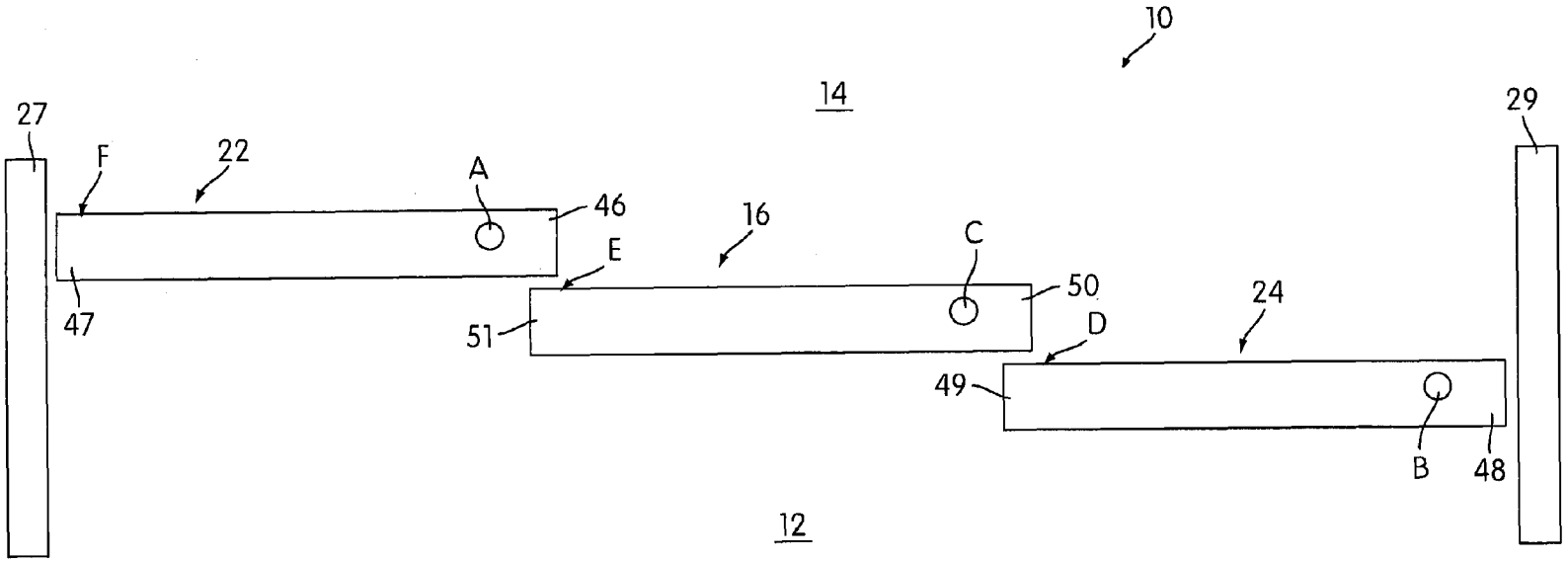
FIG. 1B is a top view of the door assembly in the closed position in accordance with FIG. 1A.
Figure 2A:
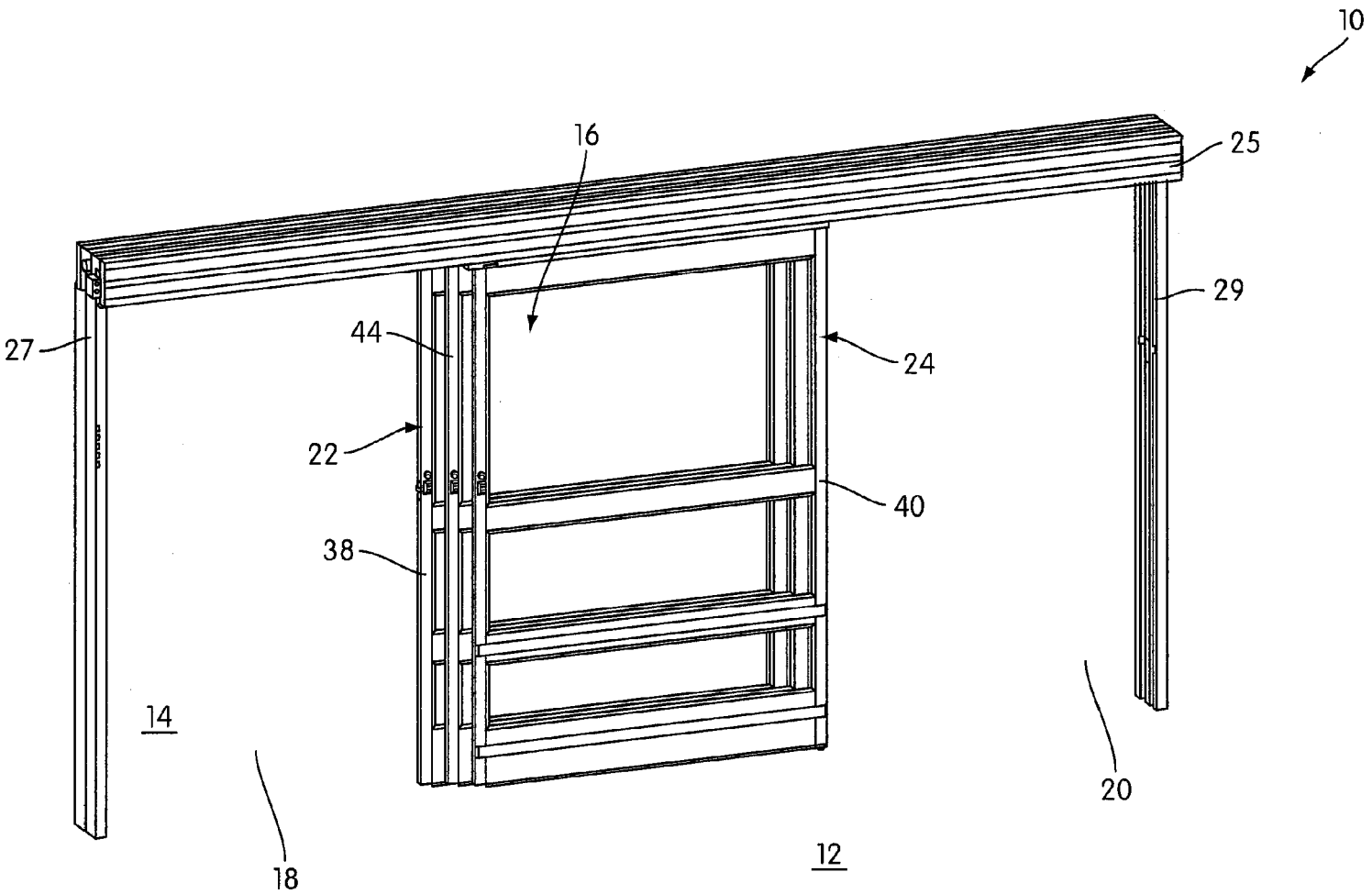
FIG. 2A is a perspective view of the door assembly in an open position in accordance with an embodiment.
Figure 2B:
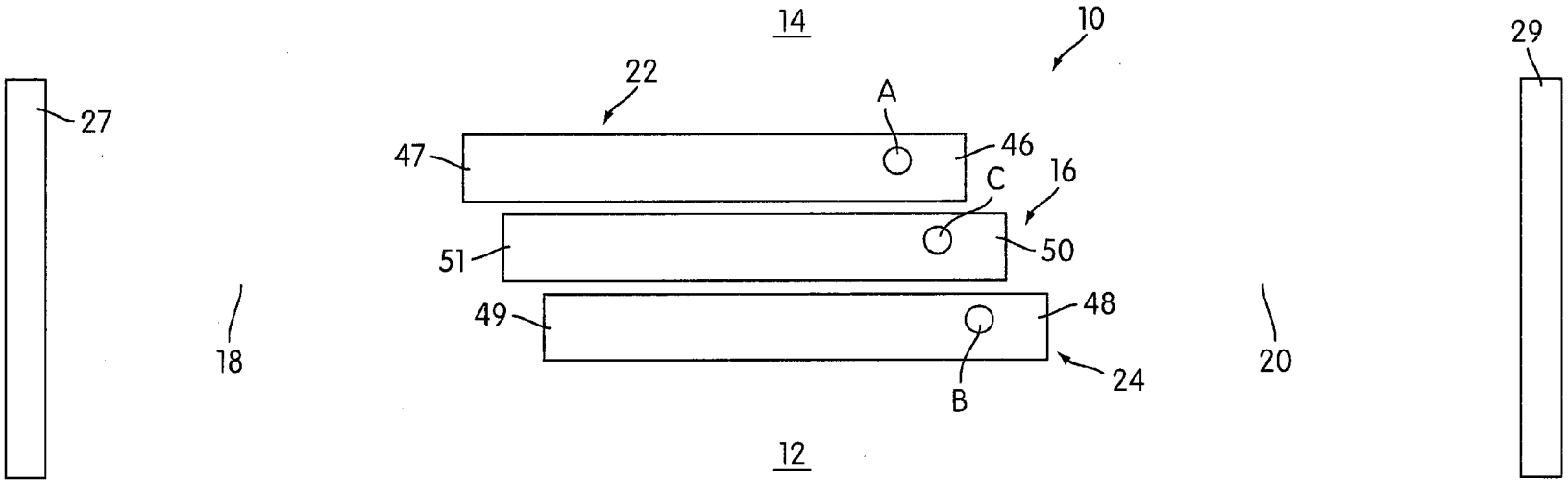
FIG. 2B is a top view of the door assembly in the closed position in accordance with FIG. 2A.

In one embodiment, the sliding door panels 22, 24 can be pivoted away from the normal configuration when the sliding door panels 22, 24 are in the closed position (as shown in FIG. 1A), in the open position (wherein the sliding door panels 22, 24 in a substantially overlapping relationship with the normally fixed door panel 16 as shown in FIG. 2A), or in an intermediate position therebetween (not shown). In the overlapped configuration, the normally fixed door panel 16 may be positioned between the first and second sliding door panels 22, 24. It should be appreciated that with respect to the term "overlapping," this relates to the fact that the door panels 16, 22, 24 may be in a substantially overlapping configuration, a slightly overlapping configuration, or completely overlapping configuration. For example, when the sliding door panels 22, 24 are in the fully open position as shown in FIGS. 2*a* and 2*b*, the door panels 22, 24 may be in a substantially but not completely overlapping configuration with the normally fixed door panel 16. That is, portions of the door panels 16, 22, 24 may be exposed and not completely blocked by the other door panels 16, 22, 24 when the door panels 16, 22, 24 are in the overlapping configuration. In other words, the door panels 16, 22, 24 may be offset from each other in both the vertical and horizontal directions, as shown in FIG. 2B. However, it is contemplated that in other embodiments, the door panels 16, 22, 24 may be in a compact, completely overlapping configuration when the sliding door panels 22, 24 are in the completely open position. In such embodiments, the door panels 16, 22, 24 may be in a completely stacked or overlapped relationship wherein when viewed from the first side 12, the frame 40 of the second sliding door panel 24 completely blocks the frames 44, 38 of the normally fixed door panel 16 and the first sliding door panel 22 from view. In either case, in the open position, the overlap is such that it permits persons to pass through the associated door openings. Furthermore, it should be appreciated that when the sliding door panels 22, 24 are in the closed position as shown in FIGS. 1A and 1B, there may be slight overlapping between the sliding door panels 22, 24 and the normally fixed door panel 16. That is, in one embodiment, there may be some slight overlap 1) between portions of the pivot stile 46 of the first sliding door panel 22 and portions of the leading stile 51 of the normally fixed door panel 16 and 2) between portions of the pivot stile 50 of the normally fixed door panel 16 and portions of the leading stile 49 of the second sliding door panel 24. In other embodiments, it is contemplated that there is no overlap when the doors are closed.

FIGS. 1A and 1B show a perspective view and a top view, respectively, of the sliding door panels 22, 24 in the closed position wherein egress and ingress through the openings 18, 20 are prevented. In such an embodiment, there may be slight overlapping between the door panels 16, 22, 24, as mentioned above. However, the pivot axes A, B, C of the door panels 16, 22, 24 may be positioned such that although there is slight overlapping between the door panels 16, 22, 24, each of the door panels 16, 22, 24 may be individually pivoted to the breakaway configuration when the door panels 16, 22, 24 are in the closed position as shown in FIG. 1B. That is, in this embodiment, the pivot axes A, B, C, of the door panels 16, 22, 24 are arranged such that each of the door panels 16, 22, 24 may be pivoted without pivoting any of the other door panels 16, 22, 24 because of the displacement of the pivot axes A, B away from the leading stile 51, 49 of the door panels 16, 24. However, it is contemplated that in other embodiments, the pivot axes A, B, C may be located in other locations. It is also contemplated in other embodiments, that the door panels 16, 22, 24 may optionally be arranged such that 1) the door panel 22 may only pivot to the breakout configuration when the normally fixed door panel 16 and the sliding door panel 24 are also pivoted to the breakout configuration, 2) the door panel 16 may only pivot to the breakout configuration when the sliding door panel 24 is also pivoted to the breakout configuration, and/or 3) the sliding door panel 24 may pivot to the breakout configuration without pivoting any other door panels 16, 22. However, this example is not intended to be limiting and the door assembly 10 may be arranged in other ways.

In embodiments where the door panels 16, 22, 24 may each be independently and individually pivoted to the breakout configuration from the closed position as shown in FIG. 1A, in some situations, the pivoting of the door panels 16, 22, 24 may cause other door panels 16, 22, 24 to be pivoted to the breakout configuration as well. For example, in the embodiment shown in FIG. 1B, the second sliding door panel 24 is located closer to the first side 12 than the normally fixed door panel 16. The normally fixed door panel 16 is located closer to the first side 12 than the first sliding door panel 22. To pivot the second sliding door panel 24 towards the first side 12 to the breakout configuration, the user may push at or near position D (for the most leverage) so that the door panel 24 may pivot along pivot axis B. To pivot the normally fixed door panel 16 towards the first side 12 to the breakout configuration, the user may push at or near position E (for the most leverage) so that the door panel 16 may pivot along pivot axis C. To pivot the first sliding door panel 22 towards the first side 12 to the breakout configuration, the user may push at or near position F (for the most leverage) so that the door panel 22 may pivot along axis A. However, if sliding door panel 24 is in an intermediate position between the open and closed position wherein access to position D is prevented by the normally fixed door panel 16, the normally fixed door panel 16 may be required to be pivoted to the breakout configuration in order to pivot the sliding door panel 24 to the breakout configuration. Similarly, if the sliding door panel 22 is in the intermediate position between the open and closed position such that sliding door panel 22 prevents access to position E of the normally fixed door panel 16, the sliding door panel 22 may be required to be pivoted to the breakout configuration in order to pivot the normally fixed door panel 16 to the breakout configuration. Thus, it should be appreciated that in some situations, to pivot one or both the normally fixed door panel 16 and the second sliding door panel 24 may require the pivoting of the other door panels 16, 22, 24. Along a similar logic, the pivoting of the sliding door panel 22 may also require the pivoting of the other door panels 16, 24 and the pivoting of the normally fixed door panel 16 may also require the pivoting of the door panel 24 because of the obstruction that may be caused by the other door panels 16, 24 or the door panel 24. However, it should be appreciated that these descriptions are intended to be examples and are not intended to be limiting in anyway.

FIGS. 2A-B show a perspective view and a top view, respectively, of the sliding door panels 22, 24 in the open position wherein egress and ingress through the openings 18, 20 are permitted. In such an embodiment, there may be substantial but not complete overlapping of the door panels 16, 22, 24, as mentioned above.

FIG. 3 is a perspective view of the sliding door panels 22, 24 and the normally fixed door panel 18 pivoted to the breakaway configuration from the closed position shown in FIG. 1A. In such an embodiment, three openings 18, 20, 34 are created by the pivoting of the door panels 16, 22, 24 to the breakaway configuration. It is contemplated that the door panels 16, 22, 24 may be pivoted to the breakaway configuration when the sliding door panels 22, 24 are located at other positions with respect to the normally fixed door panel 16.

Figure 4:
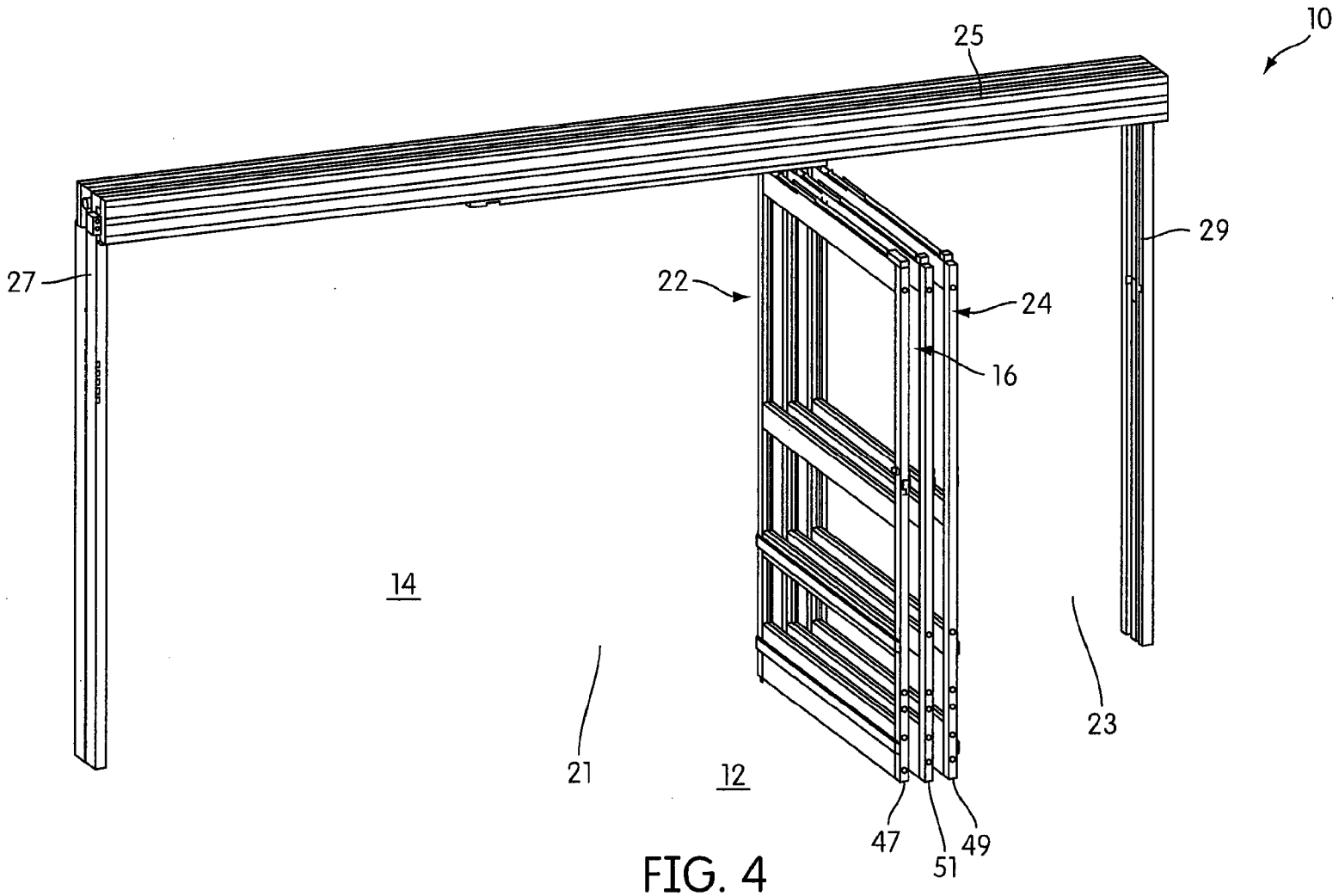
FIG. 4 is a perspective view of the door assembly with the normally fixed door panel and the first and second sliding panels pivoted to a utility breakaway configuration from the position shown in FIG. 2A.

FIG. 4 is a perspective view of the sliding door panels and the normally fixed door panel pivoted to the breakaway configuration from the open position shown in FIG. 2A. In such an embodiment, this breakout configuration may be considered a utility breakout configuration wherein a large opening 21 is formed on one side of the overlapped door panels 16, 22, 24 and a small opening 23 is formed on the other side. Thus, the overlapped door panels 16, 22, 24 may be located between the small opening 23 and the large opening 21. The small opening 23 may be the size as the ingress opening 20. The large opening 21 may be the same or larger than the combination of the egress opening 18 and the center opening 34. Accordingly, the larger opening 21 enables wider access therethrough than each of the separate openings that are formed when the door panels 16, 22, 24 are broken out to the breakaway configuration from positions other than the open position shown in FIG. 2A. It is also contemplated that the sliding door panels 22, 24 may be slid along the header 25 after the sliding door panels 22, 24 have been pivoted to the breakaway configuration to vary the size or arrangement of the openings. In embodiments where the normally fixed door panel 16 may also be slid along the header 25, the normally fixed door panel 16 may also optionally be capable of sliding along the header 25 after the normally fixed door panel 16 has been pivoted to the breakaway configuration.

Figure 6:
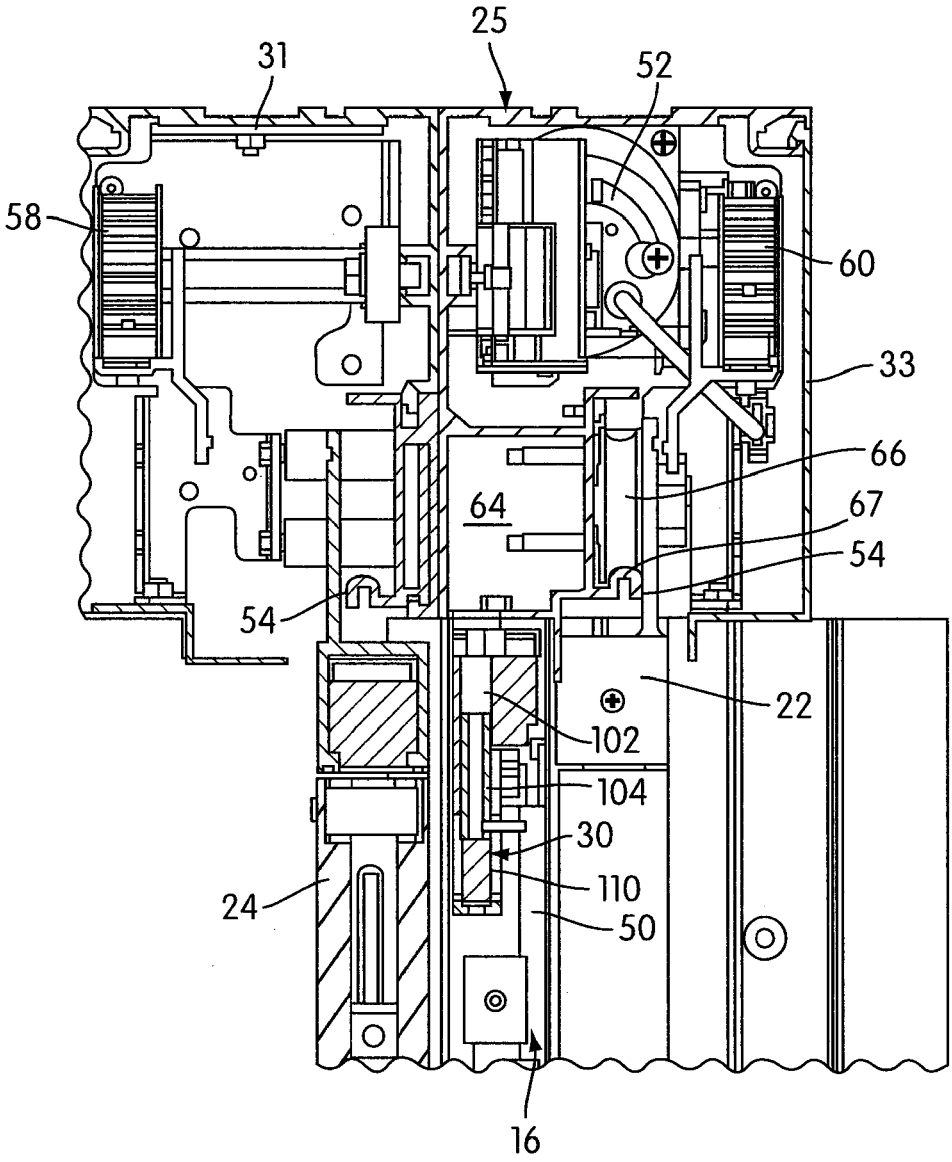
FIG. 6 is a partial cross sectional view of a header, normally fixed door panel, and first and second sliding door panels of the door assembly.

In normal operation of the sliding door panels 22, 24, when a motion sensor (as known in the art) detects an individual approaching the doorway, a door opening signal is generated and input to a controller or processor (not shown), which in turn generates a signal to drive a motor 52 (as shown in FIG. 6). The motor 52 operates to slide the sliding door panel 22 rightward (with respect to the view shown in FIG. 1A) towards the normally fixed door panel 16 from the closed position covering the egress opening 18 through an intermediate position and then to the open position (i.e., where the sliding door panel 22 is substantially overlapped by the normally fixed door panel 16 (as shown in FIG. 2A), thereby permitting egress through the opening 18. Similarly, a motor (not shown) may be provided for the second sliding door panel 24 that operates to slide the sliding door panel 24 leftward (with respect to the view shown in FIG. 1A) towards the normally fixed door panel 16 from the closed position covering the ingress opening 20 through an intermediate position and then to the open position (i.e., where the sliding door panel 24 is substantially overlapped by the normally fixed door panel 16 (as shown in FIG. 2A), thereby permitting ingress through the opening 20.

After a predetermined period of time, the controller generates a door closing signal to cause the motors 52 to return the sliding door panels 22 and 24 to the closed position of FIG. 1A. The aforementioned sensor for sensing the presence of an individual, and controller, and can be of various types that are well known in the art.

Figure 5:
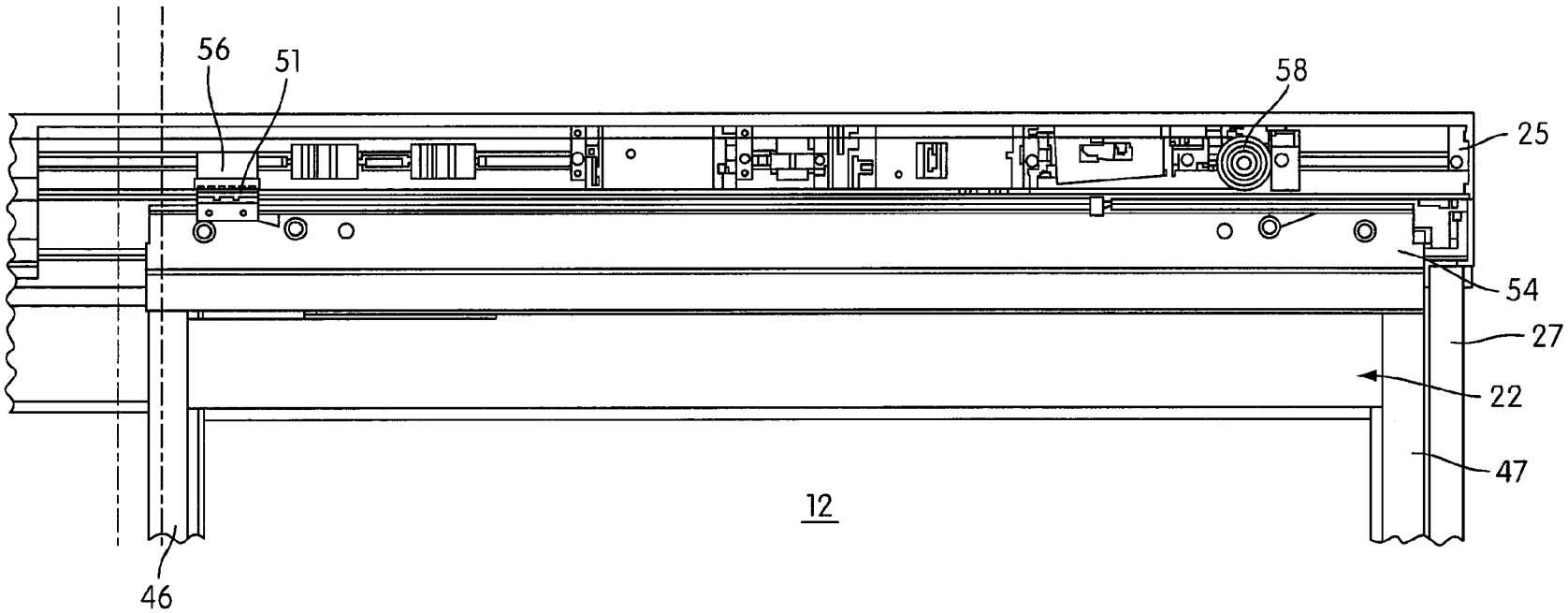
FIG. 5 is a partial front view of the first sliding door panel of the door assembly with certain parts removed to better reveal others.

FIG. 5 is a partial front view from the second side (i.e., the inside) of parts of the door assembly with certain parts removed to better reveal others. In the illustrated embodiment, the sliding door panel 22 may be connected to a section of a continuous toothed belt 51. The continuous toothed belt 51 is looped about an idler pulley 58 and a drive pulley 60 (see FIG. 6). In one embodiment, the continuous toothed belt 51, the idler pulley 58, and the drive pulley 60 may be together considered a belt system. The idler pulley 58 is remotely rotated by the drive pulley 60 and the drive pulley 60 is generally rotationally driven by the motor 52. The drive pulley 60 is constructed and arranged to transmit force to the idler pulley 58 through the belt 51. In one embodiment, the belt 51 may include a set of teeth which engage corresponding teeth sets extending from the pulleys. The motor 52 may directly drive the drive pulley 60 or may do so through, for example, a gearbox. The drive pulley 60 is rotationally driven by the motor 52 for linearly moving the sliding door panel 22 in a direction of sliding. It should be appreciated that the sliding door panel 24 may also be constructed and arranged in a similar manner. Furthermore, the sliding door panel 24 may also include similar components and may operate in a similar manner as the sliding door panel 22 described above. It is contemplated that the location of the motor 52, the drive pulley 60, and the idler pulley 58 may vary in other embodiments.

In the illustrated embodiment, the sliding door panel 22 is operatively attached to the header 25 via a hanger 54. The hanger 54 may be constructed and arranged to enable the sliding door panel 22 to slide along the header 25 between the open and closed positions. The hanger 54 may be connected to the header 25 via a connector or connecting member 56. The connecting member 56 may be used to securely connect the sliding door panel 22 to a section of the continuous toothed belt 51. In one embodiment, the connecting member 56 may include a set of teeth which engage corresponding teeth sets extending from the continuous toothed belt 51. Fastening means or other types of connecting means may be used to clamp or attach the connecting member 56 to the continuous toothed belt 51, thus enabling movement of the connecting member 56 with the continuous toothed belt 51. Accordingly, the connecting member 56 is used to securely connect the first sliding door panel 22 to the continuous toothed belt 51 to facilitate linear movement of the first sliding door panel 22 in the direction of sliding. It is contemplated that similar components (e.g., connecting member 56, toothed belt 51) may be used to enable linear movement of the second sliding door panel 24 in the direction of sliding.

FIG. 6 shows a partial cross sectional view of the door assembly 10. As shown in the illustrated embodiment, the normally fixed door panel 16 may be connected to the header 25 via a hanger 64. The hanger 64 may be fixed to the header 25, thus rendering the normally fixed door panel 16 incapable of sliding. However, it is contemplated that in some embodiments, the normally fixed door panel 16 may be provided with a header (e.g., that is similarly constructed as the headers 54 for the sliding door panels 22, 24) that enables the normally fixed door panel 16 to slide along the header 25. In such embodiments, the size of the openings formed by the door panels 16, 22, 24 during the breakaway configuration may be varied by sliding each of the door panels 16, 22, 24 to various positions. As such, in one embodiment, all of the door panels 16, 22, 24 may be slid near either the first or second door jamb 27, 29 to maximize the size of the opening to enable egress/ingress therethrough. Furthermore, it is contemplated that the door panels 16, 22, 24 may be slid along the header 25 after the panels 16, 22, 24 have been pivoted to the breakaway configuration. Also, it is contemplated that the door panels 16, 22, 24 may be slid manually by a user. As shown in the illustrated embodiment, the idler pulley 58 may be associated with the second sliding door panel 24 and the drive pulley 60 may be associated with the first sliding door panel 22. The drive pulley 60 associated with the second sliding door panel 24 and the idler pulley 58 associated with the first sliding door panel 22 are obstructed from view in this Figure.

FIG. 7 shows an exploded view of some components of the door assembly 10. In particular, FIG. 7 shows the normally fixed door panel 16 and the sliding door panel 24. The sliding door panel 22 is not shown in this Figure but the sliding door panel 22 may have a similar construction and components as sliding door panel 24. As mentioned above, the sliding door panel 24 may also be operatively connected to the header 24 via a hanger 55. The hanger 55 associated with the second sliding door panel 24 may be constructed similarly as the hanger 54 associated with the first sliding door panel 22 and may operate in a similar manner. In the illustrated embodiment, rollers or bearing wheels 66 (two are shown in this embodiment) may be mounted to the hanger 55. The rollers 66 may be constructed and arranged to roll on a track member 67 (see FIG. 6) to enable the sliding door panels 22, 24 to slide between the open and closed positions. Referring back to FIG. 7, anti-riser wheels 68 (two are shown in this embodiment) may also be mounted to the hanger 55. The anti-riser wheels 68 may be constructed and arranged to position the slidable door panel 24 with respect to the header 25. It should be appreciated that other attachment mechanisms may be used and the number and location of the wheels 66, 68 may vary in other embodiments. FIG. 7 also shows a threshold 70 that enables the sliding door panels to slide thereon between the open and closed positions. The lower pivot mechanism 28 for the sliding door panels 22, 24 are constructed and arranged to facilitate sliding movement along the threshold 70. The lower pivot mechanism 28 will be described in more detail later. As mentioned above, it is contemplated that the first and sliding door panels 22, 24 may have similar construction and components and may operate in a similar manner as each other.

Figure 8:
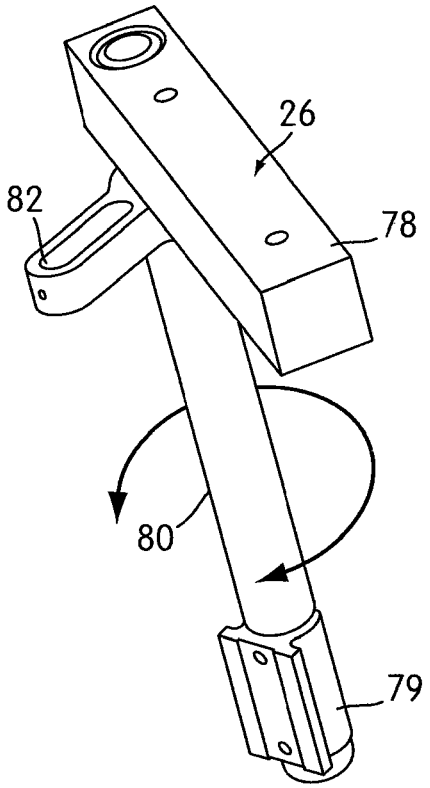
FIG. 8 shows an upper pivot mechanism for the first and second sliding door panels of the door assembly.

FIG. 8 shows the upper pivot mechanism 26 in detail. The upper pivot mechanisms 26 of the sliding door panels 22, 24 are constructed and arranged to pivot the sliding door panels 22, 24 about the pivot axes A, B from 1) the normal configuration wherein the sliding door panels 22, 24 will cover the openings 18, 20 when in the closed position to 2) the breakaway configuration wherein the sliding door panels 22, 24 are pivoted away from the normal configuration. The upper pivot mechanism 26 may include an upper portion 78 configured to be attached to the hangers 54, 55. The upper pivot mechanism 26 may also include a lower portion 80 constructed and arranged to be received in the pivot stile 46, 48 of the sliding door panels 22, 24, respectively. An arm portion 82 may be constructed and arranged to be rotatable with respect to the upper portion 78 and may be received in a portion of the sliding door panel 22, 24 to enable the sliding door panel 22, 24 to rotate or pivot with respect to the hangers 54, 55 during breakaway. An attachment portion 79 may be provided on the lower portion 80 to facilitate the attachment of the pivot mechanism 26 to the sliding door panels 22, 24.

Figure 9:
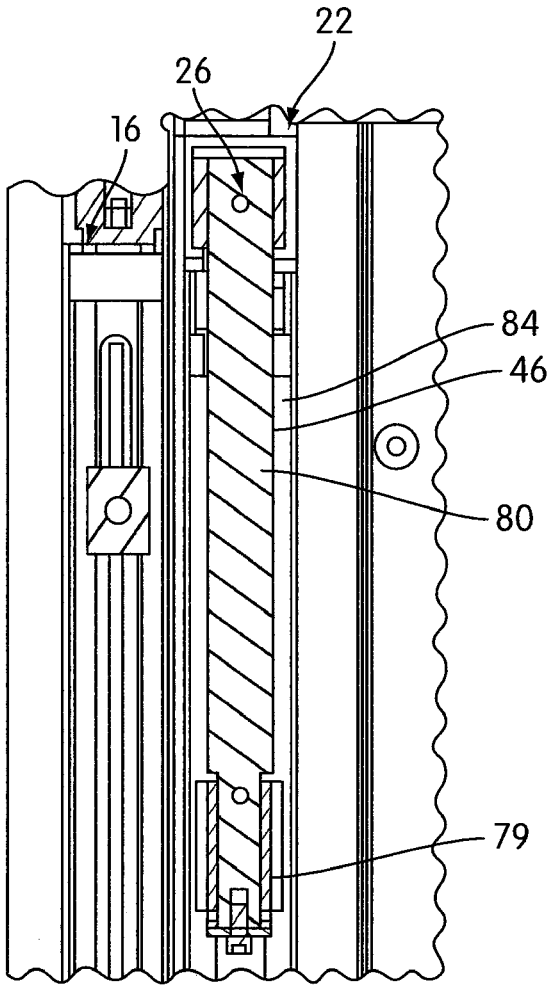
FIG. 9 is a partial cross sectional view of an upper portion of the normally fixed door panel and the first sliding door panel showing the upper pivot mechanism disposed in the first sliding door panel.

FIG. 9 is a partial cross sectional view of the upper pivot mechanism 26 disposed in the pivot stile 46 of the sliding door panel 22. The sliding door panel 22 may include a receiving region 84 constructed and arranged to receive portions of the pivot mechanism 26, such as the lower portion 80 and the attachment portion 79 of the pivot mechanism 26. The upper pivot mechanism 26 may be similarly disposed in the pivot stile 48 of the second sliding door panel 24.

Figure 10A:
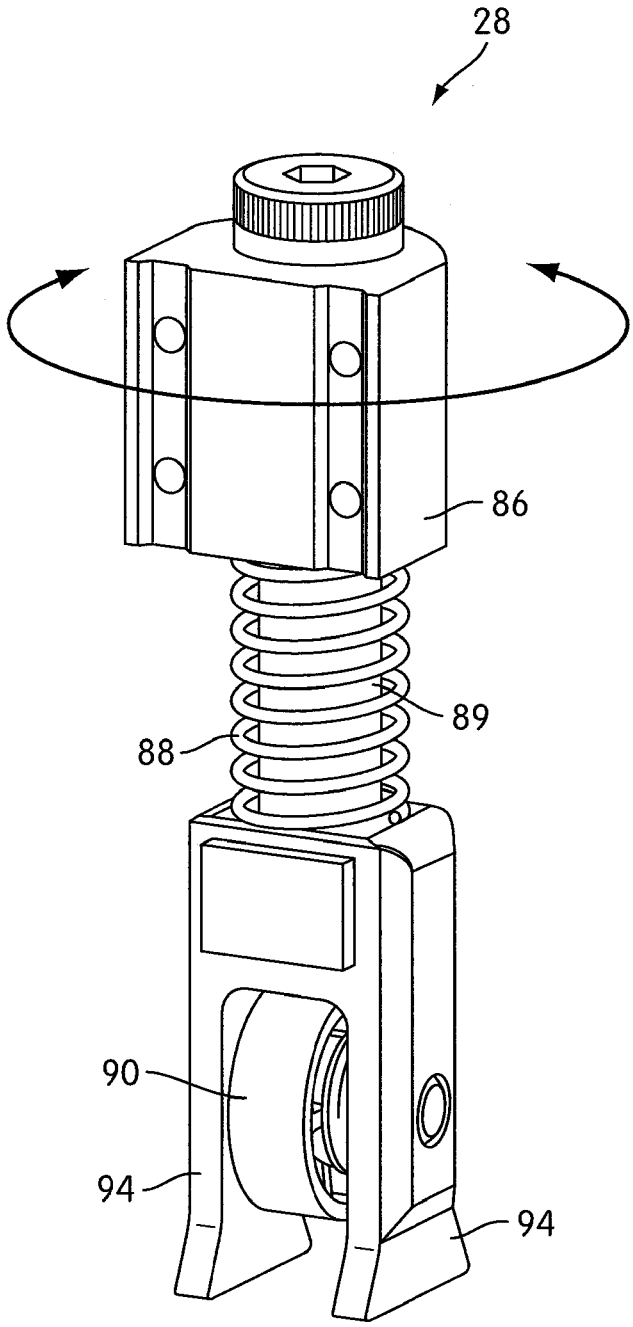
FIG. 10A shows a lower pivot mechanism for the first and second sliding door panels of the door assembly.
Figure 10B:
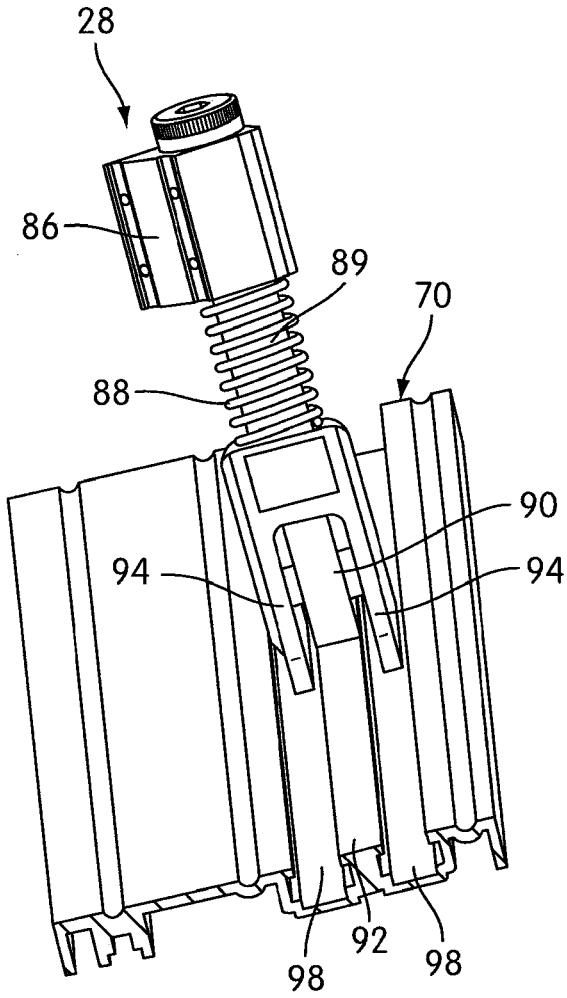
FIG. 10B shows the lower pivot mechanism of the first and second sliding door panels disposed on a threshold.

FIG. 10A-10B show in detail the lower pivot mechanism 28 of the sliding door panels 22, 24. The lower pivot mechanism 28 may operate with the upper pivot mechanism 26 to enable the sliding door panels 22, 24 to pivot to the breakaway configuration. The lower pivot mechanism 28 may include an upper portion 86 constructed and arranged to be received in the sliding door panels 22, 24, such as in the pivot stiles 46, 48 of the sliding door panels 22, 24. The upper portion 86 may be constructed and arranged to rotate with respect to the other portions of the lower pivot mechanism 28. A roller member 90, which takes the form of a wheel in this embodiment, may be constructed and arranged to contact or roll against a raised portion 92 of the threshold 70 during sliding movement of the sliding door panels 22, 24 between the open and closed positions. A bias member 88, which takes the form of a spring in this embodiment, may be provided around a middle portion 89 of the lower pivot mechanism 28 to bias the roller member 90 against the raised portion 92 of the threshold 70. The roller member 90 may be located between a pair of extending arms 94. The extending arms 94 may each be constructed and arranged to be received in a recess 98 formed in the threshold 70.

Figure 11:
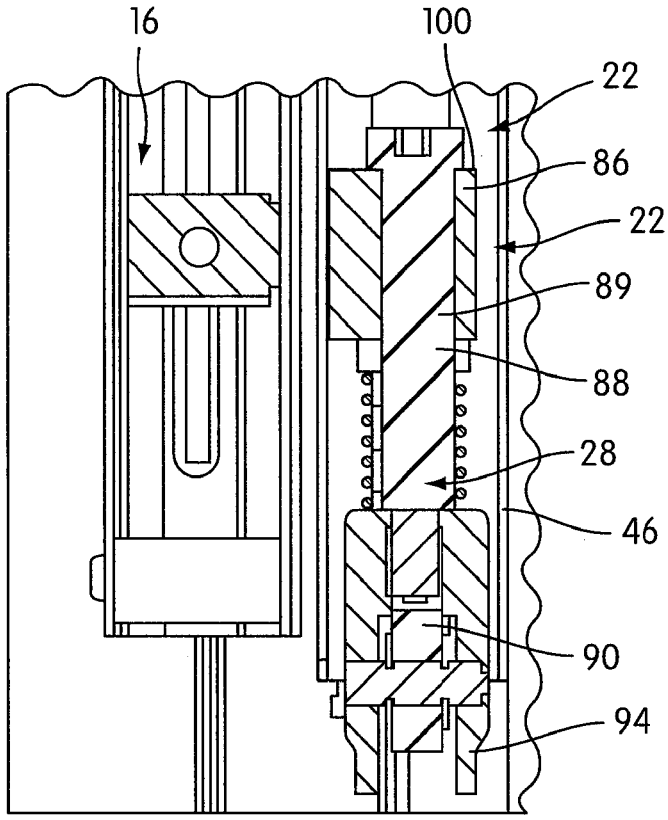
FIG. 11 shows a partial cross sectional view of a lower portion of the normally fixed door panel and the first sliding door panel showing the lower pivot mechanism disposed in the first sliding door panel.

FIG. 11 is a partial cross sectional view of the lower pivot mechanism 28 disposed in the pivot stile 46 of the sliding door panel 22. The pivot stile 46 of the sliding door panel 22 may include a receiving region 100 constructed and arranged to receive portions of the lower pivot mechanism 28 (e.g., the upper portion 86 and the middle portion 89). The lower pivot mechanism 28 may be similarly disposed in the pivot stile 48 of the second sliding door panel 24.

Figure 12:
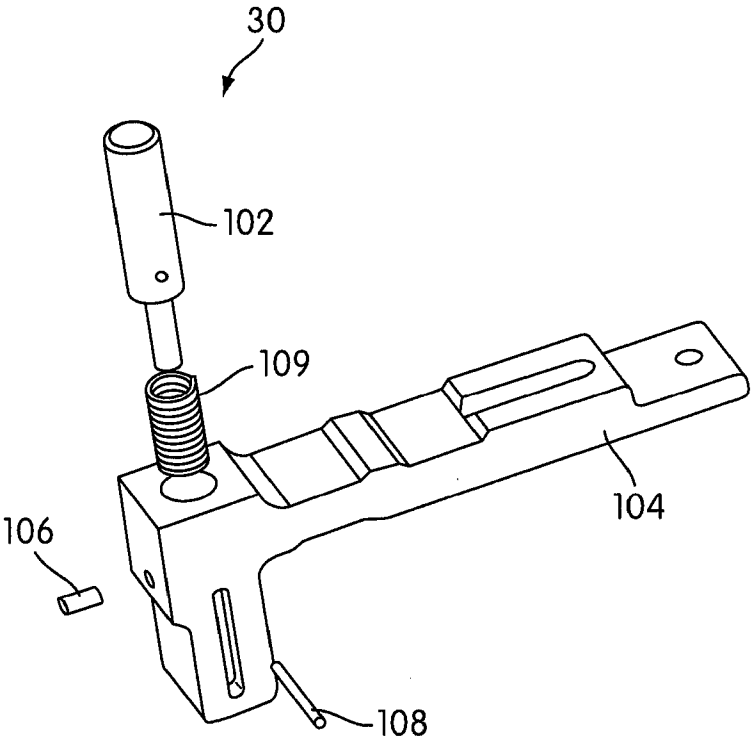
FIG. 12 is an exploded view of an upper pivot mechanism for the normally fixed door panel.

FIG. 12 is an exploded view of the upper pivot mechanism 30 for the normally fixed door panel 16. The upper pivot mechanism 30 may include a pivot pin 102 constructed and arranged to connect to the hanger 64 or the header 25 to enable pivoting of the normally fixed door panel 16. The pivot mechanism 30 may also include a housing portion 104 constructed and arranged to be received in the normally fixed door panel 16. The pivot pin 102 may be received in the housing portion 104. A biasing member 104, taking the form of a spring in this embodiment, may be provided to bias the pivot pin 102 against the hanger 64. Pins 106, 108 or other attachment mechanisms may be provided to connect the components of the pivot mechanism 30.

Referring back to FIG. 6, the pivot mechanism 30 may be received in the pivot stile 50 of the normally fixed door panel 16. The pivot stile 50 may include a receiving region 110 constructed and arranged to receive portions of the pivot mechanism 30 (e.g., the pivot pin 102 and the housing portion 104).

Figure 13:
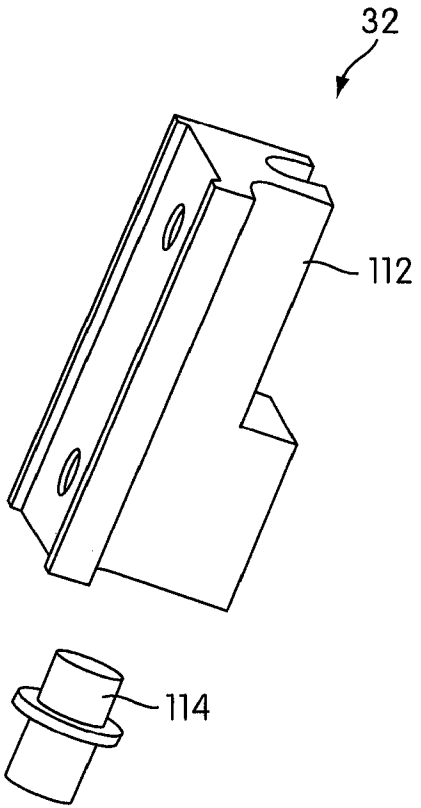
FIG. 13 shows a lower pivot mechanism for the normally fixed door panel.

FIG. 13 shows in detail the lower pivot mechanism 32 for the normally fixed door panel 16. The lower pivot mechanism 32 includes a main housing portion 112 constructed and arranged to be received in the pivot stile 50 of the normally fixed door panel 16 and a pivot pin 114 constructed and arranged to be received in the main housing portion 112. The pivot pin 114 may also be constructed and arranged to be received in a portion of the threshold 70 to enable the normally fixed door panel 16 to pivot relative to the header 25 to the breakaway configuration. Thus, the lower pivot mechanism 32 may and the upper pivot mechanism 30 may operate to enable the normally fixed door panel 16 to pivot to the breakaway configuration.

Figure 14:
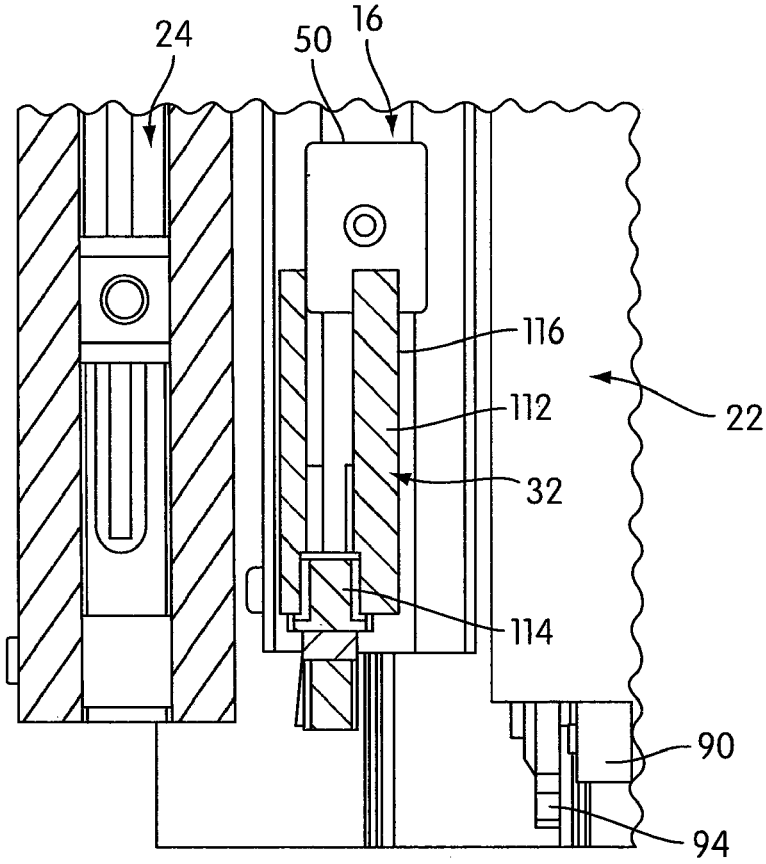
FIG. 14 is a partial cross sectional view of a bottom portion of the second sliding door panel and the normally fixed door panel showing the lower pivot mechanism disposed in the normally fixed door panel.

FIG. 14 shows a partial cross sectional view of the lower pivot mechanism 32 disposed in the pivot stile 50 of the normally fixed door panel 16. A receiving region 116 may be provided in the pivot stile 50 to receive portions of the lower pivot mechanism 32 (e.g., the main housing 112 and portions of the pivot pin 114).

Figure 15:
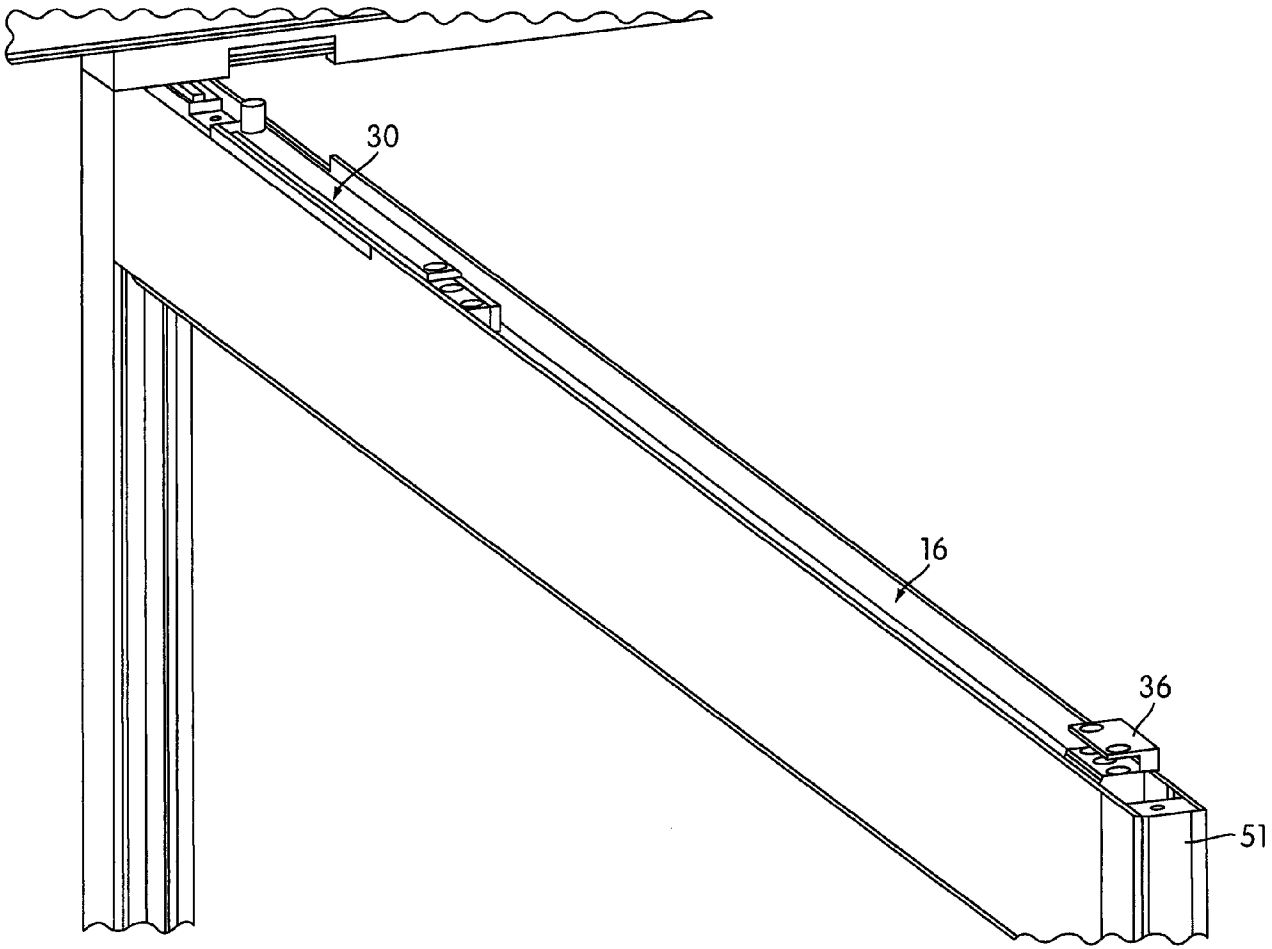
FIG. 15 is a detailed perspective view of an upper portion of the normally fixed door panel with a lock arrangement.

FIG. 15 is a partial perspective detailed view of the normally fixed door panel 16. The normally fixed door panel 16 is provided with the upper pivot mechanism 30 and the lock arrangement 36 at or near the leading stile 51. The sliding door panels 22, 24 may also have a lock arrangement 36 at or near their leading stiles 47, 49, respectively.

Figure 16:
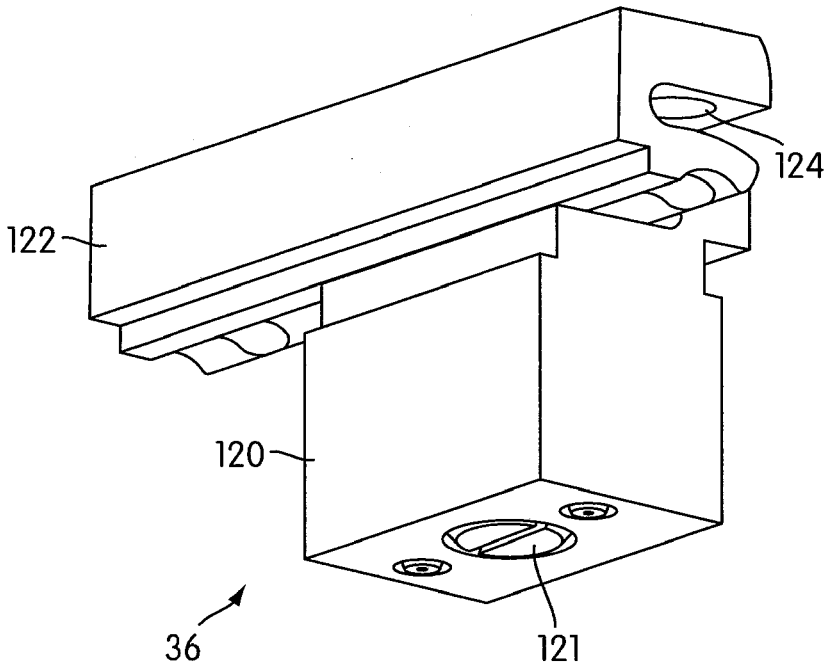
FIG. 16 shows the lock arrangement for the normally fixed door panel and the first and second sliding door panels.

FIG. 16 shows the lock arrangement 36 in more detail. The lock arrangement 36 is constructed and arranged to releasably lock the frames 38, 40, 44 of the door panels 22, 24, 16 to their hangers 54, 55, 64 to prevent pivotal movement of the door panels 16, 22, 24 away from the normal configuration. In the illustrated embodiment, the lock arrangement 36 includes a door lock member 120 constructed and arranged to be received in the frames 38, 40, 44 of the door panels 22, 24, 16. A retaining structure 122 may be constructed and arranged to be received in the hangers 54, 55, 64. The retaining structure 122 may be further constructed and arranged to engage with the door lock member 120. In the illustrated embodiment, a channel 124 is provided in the retaining structure 122 to receive an extension portion 126 (see FIG. 17) of the door lock member 120. A movable member receiving opening 128 (see FIG. 17) may be provided in the retaining structure 122 to receive a moveable member 130 (see FIG. 17) of the door lock member 120. In one embodiment, the movable member 130 is constructed and arranged to be movable between a locking position and an unlocking position. In one embodiment, the movable member 130 is constructed and arranged to move in a linear motion (i.e., up and down). The movement of the movable member 130 from the locking position to the unlocking position unlocks the frames 38, 40, 44 of the door panels 22, 24, 16 from the hangers 54, 55, 64 so as to enable the door panels 22, 24, 16 to pivot to the breakaway configuration. A pin or screw 121 may be provided on the door lock member 120 to connect the components of the door lock member 120 and/or to facilitate the attachment of the door lock member 120 to the door panels 16, 22, 24.

The lock arrangement may be biased into the locking position by a biasing member 132 (see FIG. 17), which takes the form of a spring in this embodiment. In one embodiment, the biasing member 132 may be a coil spring or a compression spring. The movable member 130 is configured to be received in the movable member receiving opening 128 by the biasing member 132. The biasing member 130 forces/biases the movable member 130 into its locking position. Thus, the biasing member 130 is constructed and arranged to releasably lock the door panels 22, 24, 16 to prevent pivoting movement thereof.

Figure 17:
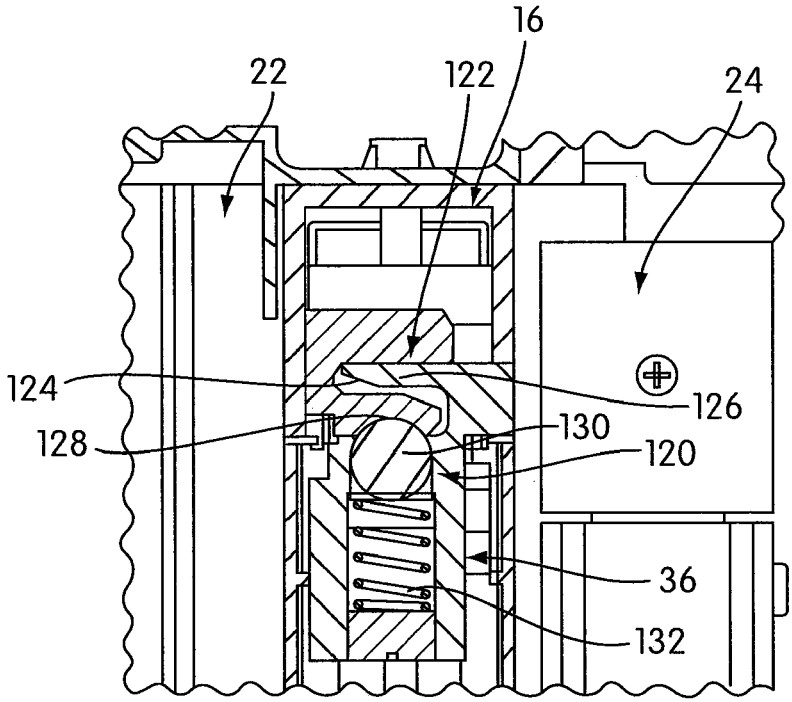
FIG. 17 shows a partial cross sectional view of an upper portion of the first and second sliding door panels and the normally fixed door panel with the lock arrangement disposed in the normally fixed door panel.

FIG. 17 shows a partial cross sectional view of the lock arrangement 36 of the normally fixed door panel 16. It is contemplated that the lock arrangement 36 of the sliding door panels 22, 24 may be constructed similarly and may operate in a similar manner as the lock arrangement 36 of the normally fixed door panel 16. In this embodiment, the movable member 130 is biased by the biasing member 132 into the locked position wherein the movable member 130 is received in the movable member receiving opening 128 formed in the retaining structure 122. Thus, the normally fixed door panel 16 is prevented from being pivoted to the breakaway configuration. In the illustrated embodiment, the movable member 130 may include a ball shaped configuration, a circular shaped configuration, a cylindrical shaped configuration, or a spherical shaped configuration as non-limiting examples. The movable member receiving opening 128 is constructed and arranged to lockingly receive the movable member 130 therein, when the lock arrangement 36 is in the locking position. The movable member receiving opening 128 generally may include a circular shaped configuration as a non-limiting example.

In order to pivot the normally fixed door panels 16 and/or the sliding door panels 22, 24, an individual may apply sufficient outward force on the frames 44, 38, 40 of the normally fixed door panel 16 and/or the sliding door panels 22, 24 to overcome the locking force of the releasable lock 36. Specifically, the outward breakout force applied to the door panel(s) moves the movable member 130 downwards from the locking position to the unlocking position. When the movable member 130 is moved from the locking position to the unlocking position, the movable member 130 is constructed and arranged to compress the bias member 132. In other words, a portion of the movable member 130, which engages with the bias member 132 at one end thereof, is constructed and arranged to compress the bias member 132 from its relaxed configuration to a compressed (or tensioned) configuration. Also, when the movable member 130 is moved from the locking position to the unlocking position (i.e., against the action of bias member 132), the movable member 130 moves down and away from the movable member receiving opening 128 in the retaining member 122 disposed in the hanger 54, 55, or 64. Thus, the movable member 130 is able to move downwardly for disengagement from the movable member receiving opening 128. This downwardly movement of the movable member 130 permits the pivotal movement of the normally fixed door panel 16 and the sliding door panels 22, 24.

In some embodiment, the door frames 38, 40, 44 may be locked/unlocked from the hangers 54, 55, 64 to enable the pivoting of the door panels 16, 22, 24 using a mechanical arrangement that may be operated manually. In other embodiments, the door frames 38, 40, 44 may be locked/unlocked from the hangers 54, 55, 64 to enable pivoting of the door panels 16, 22, 24 using an electronic arrangement. That is, the lock arrangement 36 may be constructed and arranged to optionally operate electronically, which will be described in more detail below. Thus, it should be appreciated that the lock arrangement 36 of the door assembly 10 may be operated manually, electronically, or a combination thereof.

In embodiments where the lock arrangement 36 may be operated manually, the individual may apply an outward breakout force to the door panel(s) to move the movable member 130 of the lock arrangement 36 downwards from the locking position to the unlocking position so that the door panels 16, 22, 24 may be pivoted to the breakaway configuration. As mentioned above, the bias member 132 is constructed and arranged to bias the movable member 130 from the unlocking position to the locking position so that the movable member 130 is engaged with the movable member receiving opening 128 of the retaining structure 122 disposed in the hanger 54, 55, or 64. Accordingly, when the movable member 130 is moved downwards, the movable member 130 compresses the bias member 132 so that the movable member may be moved to the unlocking position wherein the movable member 130 is removed from the movable member receiving opening 128. As a result, the door panels 16, 22, 24 may be pivoted to the breakaway configuration.

Figure 18:
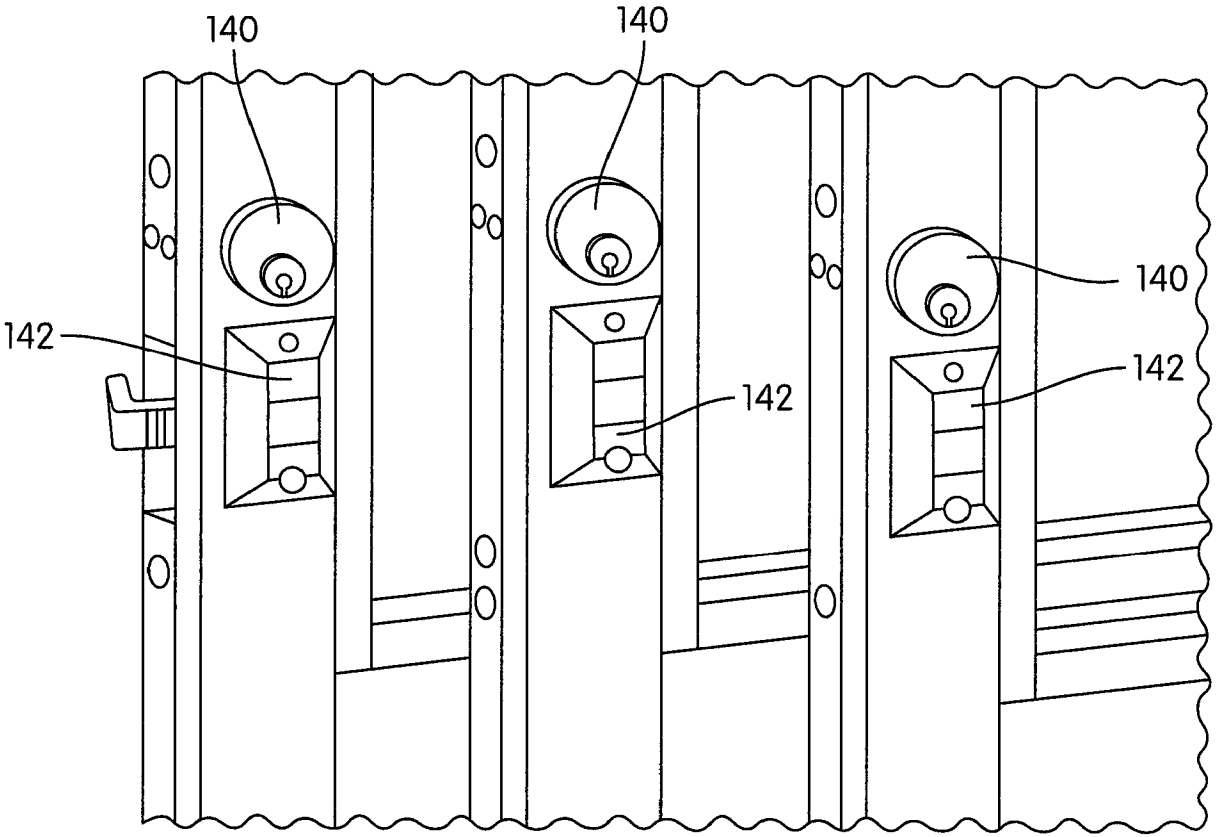
FIG. 18 shows a lock and lock indicator for the normally fixed door panel and the first and second sliding door panels.

In addition, in one embodiment, each of the door panels 16, 22, 24 may also be provided with a second lock arrangement 140 (see FIG. 18) constructed and arranged to prevent movement of the door panels 16, 22, 24 when in the locked condition or permit movement of the door panels 16, 22, 24 when in the unlocked condition. The lock arrangement 140 may include a key cylinder or other types of locks that may be moved to prevent or permit movement of the door panels 16, 22, 24. As shown in FIG. 18, an indicator 142 constructed and arranged to indicate the locked or unlocked conditions of the door panels 16, 22, 24 may be provided on each of the door panels 16, 22, 24. Thus, when the second lock arrangement 140 is in the locked condition, sliding and/or pivoting movement of the door panels 16, 22, 24 (manually and/or electronically) may be prevented.

In embodiments where the lock arrangement 36 may be operated electronically, an electronic arrangement (i.e., where a controller based on the control signals received operates the lock arrangement 36) may be used to lock or unlock the door frames 38, 40, 44 from the hangers 54, 55, 64. In such an embodiment, the electronic arrangement may include a battery back-up to power the electronic arrangement, for example, in case of a power failure.

In one embodiment, control signals may be generated within the door assembly, whereby the state of these control signals influence operation of the lock arrangement 36. For example, a door release mechanism (e.g., a push bar) may be provided on the door panels that, when operated, closes or opens a switch (e.g., a micro-switch assembly), or otherwise sends a signal to the controller, thereby indicating a request to disengage or unlock the lock arrangement 36 so that door panels 16, 22, 24 may be pivoted open. In one embodiment, a push bar may contain a micro-switch assembly that is actuated when an individual forces the push bar inwardly a predetermined distance against an internal spring that biases the push bar outwardly.

In another embodiment, the door assembly 10 does not include the door release mechanism (e.g., a push bar). In such embodiment, the door assembly 10 may include other mechanisms that are configured to send control signals to the controller indicating a request to lock or unlock the lock arrangement 36 as explained below. In such an embodiment, the door assembly 10 may include, for example, ball and spring arrangement 36 as discussed above for releasably locking door to and from pivotal movement.

In one embodiment, a key lock or keypad that may be used to lock and unlock the door panels and to enable and disable the lock arrangement 36. In such an embodiment, the key lock or keypad is configured to send control signals to the controller indicating a request to disengage or unlock the lock arrangement 36 so that the door panels 16, 22, 24 may be pivoted to the breakout configuration.

In another embodiment, a sensor or switch may be configured to detect that the door panels 16, 22, 24 have been pushed, which will generate a control signal to controller. Sensors or switches may detect displacement of the sliding door panels relative to the header or may detect application of a pivotal opening force. In one embodiment, application of pivotal opening forces may be detected by any other known means including strain gauges, changes in electrical current applied to an electromagnetic shear lock, and so on.

In one embodiment, the controller is configured to monitor control signals and to selectively enable and disable lock arrangement 36. The controller may be located in the door panel, in the hangers 54, 55, 64, or in a location remote from the door panels. A power supply may be collocated with the controller within the door assembly. For example, the power supply may be mounted in the track header and may be configured to provide power supply to the controller. The controller may process one or more signals to determine operational state of lock arrangement 36. In one embodiment, the controller includes a processor, storage, input/output devices and executes software and/or firmware configured to monitor control signals. As explained above, the control signals may be provided by sensors, switches, actuators and other externally provided controls. The controller may determine when the lock arrangement 36 should be engaged or disengaged based on the state of monitored control signals.

In one embodiment, the controller is configured to determine the status and current configuration of the sliding door system by monitoring electrical connections between the door frames 38, 40, 44 and the hangers 54, 55, 64. Based on determined status and configuration, the controller may activate and deactivate the lock arrangement 36 and may transmit alarms and monitoring signals to a centralized control system. In one embodiment, after the door panels have been pivotally opened, the controller may reactivate the lock arrangement 36 upon detecting that the door panels have been returned to its normal configuration.

It is contemplated that various methods may be employed to communicate signals to the controller. In one embodiment, switches of various kinds may be used, including push-button switches, key-activated switches, motion detector switches, RFID readers, keypads, and so on. In another embodiment, the controller may be adapted to communicate with a remote control center. The controller may be adapted by providing the controller with a communications interface for accessing wired and wireless communications interfaces including interfaces for serial data links (including modems), wired and wireless Ethernet networks, WiFi, InfraRed, Bluetooth and cellular telephone networks.

In one embodiment, a breakaway override feature may be implemented to disable the breakaway feature of the door assembly 10. In other words, it may be desirable to selectively disable the breakaway feature so that lock arrangement 36 may remain locked or enabled even when a) a manual force is applied on the door assembly 10 or b) the door release mechanism is actuated so that the door assembly 10 remains pivotally locked. Such breakaway override feature may be implemented to prevent the pivoting of the door assembly 10 as needed or desired, for example, at night when the facilities (e.g., commercial buildings) are closed for normal operation, or if the facilities (e.g., commercial buildings) may remain be vacant for an extended period of time.

In one embodiment, the breakaway override feature may be implemented using a deadbolt lock. Such deadbolt lock may be used to mechanically lock the sliding door panels 22, 24 to more securely and supplementally lock the sliding door panels 22, 24.

Such deadbolt lock arrangement may include a thumb-turn lock arrangement (not shown) mounted on the inside surface of the door assembly 10 and/or the key cylinder lock arrangement 140 (see FIG. 18) disposed on the outside or exterior surface of the door assembly 10. As know in the art, a key cam with follower and a deadbolt may be mounted within an edge of the door assembly 10. The key cam with follower and the deadbolt may be connected to the key cylinder lock arrangement and the thumb-turn lock arrangement. Also as known in the art, rotation of the key cam causes the cam follower to rotate into engagement with the deadbolt to actuate the deadbolt between a locked position and an unlocked position. The key cam may be rotated either by actuating the key cylinder lock arrangement 140 (i.e., using a key) or the thumb turn lock arrangement (i.e., using a thumb turn knob). The key cylinder lock arrangement 140 and/or the thumb-turn lock arrangement are constructed and arranged to prevent unauthorized opening of the door assembly 10.

Alternatively, the breakaway override feature may be implemented using the electronic arrangement (i.e., where a controller based on the control signals received operates the lock arrangement 36). In such an embodiment, the electronic arrangement may include a battery back-up to power the electronic arrangement, for example, in case of a power failure.

In one embodiment, when a detector or sensor for detecting an individual approaching the doorway is disabled by the controller to prevent the door panels 22, 24 from sliding to its open position, the drive mechanism or motor is configured so that it may not be back driven to thus prevent the door panels 22, 24 from being manually slid to the open position. In another embodiment, a mechanical solenoid may prevent the door panels 22, 24 from being manually slid open. In either case, however, such mechanism would not prevent or inhibit the pivotal breakaway feature, at least in most embodiments.

In one embodiment, sensors are mounted at the stiles 46, 47, 48, 49 of the sliding door panels 22, 24 to sense whether an obstacle or traffic has cleared. These sensors may include infra-red sensor, for example, mounted at the leading and trailing edges of the sliding door panels to ensure that the sliding doors do not inadvertently close. These sensors are configured to sense the presence of traffic in the doorway and to prevent the sliding doors from closing until the traffic has cleared the entranceway.

It should be appreciated that although when viewed from the first side (i.e., the outside) perspective as shown in FIG. 3, the pivot mechanisms 26, 28, 30, 32 that define the pivot axes A, B, C are located on the right side of the door panels 16, 22, 24, the pivot mechanism 26, 28, 30, 32 may be located on the left side of the door panels 16, 22, 24. Furthermore, although the door assembly 10 is arranged such that the first sliding door panel 22 is positioned closer to the second side 14 (i.e., the inside) than the second sliding door panel 24, it is contemplated that the door assembly 10 may be alternatively arranged such that the second sliding door panel 24 is positioned closer to the second side 14 than the first sliding door panel 22. Thus, the arrangement of the door panels 16, 22, 24 and the positioning of the pivot axes A, B, C of the door panels 22, 24, 16 may vary in other embodiments.

Although the invention has been described in detail for the purpose of illustration, it is to be understood that such detail is solely for that purpose and that the invention is not limited to the disclosed embodiments, but, on the contrary, is intended to cover modifications and equivalent arrangements that are within the spirit and scope of the appended claims. In addition, it is to be understood that the present invention contemplates that, to the extent possible, one or more features of any embodiment can be combined with one or more features of any other embodiment.

What is claimed is:

1. A door assembly, mounted in a doorway of a wall, configured to permit or prevent passage between a first side and a second side, the door assembly comprising:

a fixed door panel having a closed position, the fixed door panel disposed between an ingress opening and an egress opening;

a sensor assembly configured to detect an individual approaching the doorway;

a first sliding door panel slidable between 1) a closed position wherein the first sliding door panel blocks the egress opening; and 2) an open position wherein the first sliding door panel is in an overlapping configuration with the fixed door panel so as to permit persons to egress through the egress opening;

a second sliding door panel slidable between 1) a closed position wherein the second sliding door panel blocks the ingress opening; and 2) an open position wherein the second sliding door panel is in an overlapping configuration with the fixed door panel so as to permit persons to ingress through the ingress opening; and a drive system constructed and arranged to effect sliding movement of the first sliding door panel between its open and closed positions and to effect sliding movement of the second sliding door panel between its open and closed positions;

wherein the fixed door panel is pivotable to a breakout open position upon receiving a pivoting actuation, and wherein the sensor assembly is operatively connected with the drive system such that detection of the approaching individual causes 1) sliding movement of the first sliding door panel towards the fixed door panel from the closed position to the open position so as to permit the approaching individual to egress through the egress opening;

2) sliding movement of the second sliding door panel towards the fixed door panel from the closed position to the open position so as to permit the approaching individual to ingress through the ingress opening; or both;

wherein the first and second sliding door panels are each pivotable to a breakout open configuration upon receiving a pivoting actuation; and wherein the fixed door panel and the first and second sliding door panels are each constructed and arranged to be independently pivotable to the breakout open configuration when the first and second sliding door panels are in the closed position, the open position, or in an intermediate position therebetween.

2. The door assembly of claim 1, wherein when the first sliding door panel and the second sliding door panel are in the closed position, portions of stiles of the first and second door panels are in an overlapping configuration with portions of stiles of the fixed door panel.

3. The door assembly of claim 1, wherein when the first sliding door panel and the second sliding door panel are in the open position, the first and second sliding door panels are in a substantially overlapping configuration with the fixed door panel so as to permit egress through the egress opening and to permit the ingress through the ingress opening.

4. The door assembly of claim 1, wherein the fixed door panel is constructed and arranged to be slideable.

5. The door assembly of claim 1, wherein the fixed door panel is constructed and arranged to be incapable of sliding.

6. The door assembly of claim 1, wherein when the fixed door panel and the first and second sliding door panels are all pivoted to the breakout configuration, a large opening and a small opening are formed to enable passage between the first side and the second side.

7. The door assembly of claim 1, wherein the fixed door panel comprises an upper and lower pivot structure constructed and arranged to enable pivotal movement of the fixed door panel.

8. The door assembly of claim 1, wherein the first and second sliding door panels each comprise an upper and lower pivot structure constructed and arranged to enable pivotal movement of the first and second sliding door panels.

9. The door assembly of claim 1, wherein the fixed door panel and the first and second sliding door panels are constructed and arranged such that when the first and second sliding door panels are in the open position, the fixed door panel and the first and second sliding door panels are in an overlapping configuration with the fixed door panel disposed between the first and second sliding door panels.

10. The door assembly of claim 1, wherein the first and second sliding door panels are constructed and arranged to be manually slideable when in the breakout open configuration.

11. The door assembly of claim 10, wherein the fixed door panel is constructed and arranged to be slideable along a door header when in the breakout open configuration.

12. The door assembly of claim 1, wherein the first sliding door panel comprises a first hanger constructed and arranged to enable sliding movement of the first sliding door panel.

13. The door assembly of claim 1, wherein the second sliding door panel comprises a second hanger constructed and arranged to enable sliding movement of the first sliding door panel.

14. The door assembly of claim 1, wherein the fixed door panel comprises a lock arrangement constructed and arranged to lock the fixed door panel in the closed position.

15. The door assembly of claim 1, wherein the first and second sliding door panels each comprise a lock arrangement constructed and arranged to lock the sliding door panels to prevent pivoting thereof.

16. The door assembly of claim 1, wherein the second sliding door panel is constructed and arranged to be slideable relative to the fixed door panel independently of the first sliding door panel.

17. The door assembly of claim 1, wherein from an outside view of the fixed door panel and the first and second sliding door panels, each of the fixed door panel and the first and second sliding door panels has a left side and a right side, and wherein a pivot axis of each door panel is on a same side of the door panel.

18. A door assembly, mounted in a doorway of a wall, configured to permit or prevent passage between a first side and a second side, the door assembly comprising:

a fixed door panel having a closed position, the fixed door panel disposed between an ingress opening and an egress opening;

a sensor assembly configured to detect an individual approaching the doorway;

a first sliding door panel slidable between 1) a closed position wherein the first sliding door panel blocks the egress opening; and 2) an open position wherein the first sliding door panel is in an overlapping configuration with the fixed door panel so as to permit persons to egress through the egress opening;

a second sliding door panel slidable between 1) a closed position wherein the second sliding door panel blocks the ingress opening; and 2) an open position wherein the second sliding door panel is in an overlapping configuration with the fixed door panel so as to permit persons to ingress through the ingress opening; and a drive system constructed and arranged to effect sliding movement of the first sliding door panel between its open and closed positions and to effect sliding movement of the second sliding door panel between its open and closed positions;

wherein the first sliding door panel and the second sliding door panel can be pivoted to a breakout open position when in an open or partially open sliding position, and wherein the sensor assembly is operatively connected with the drive system such that detection of the approaching individual causes 1) sliding movement of the first sliding door panel towards the fixed door panel from the closed position to the open position so as to permit the approaching individual to egress through the egress opening;

2) sliding movement of the second door panel towards the fixed door panel from the closed position to the open position so as to permit the approaching individual to ingress through the ingress opening; or both;

wherein the first and second sliding door panels are each pivotable to a breakout open configuration upon receiving a pivoting actuation; and wherein the fixed door panel and the first and second sliding door panels are each constructed and arranged to be independently pivotable to the breakout open configuration when the first and second sliding door panels are in the closed position, the open position, or in an intermediate position therebetween.

19. The door system according to claim 1, wherein the sensor assembly comprises a motion detector operable to cause a door opening signal to be sent to the drive system to effect sliding movement of the first sliding door panel from the closed position to the open position, to effect sliding movement of the second sliding door panel from the closed position to the open position, or both, in response to the detector detecting the approach of an individual towards the doorway.

20. The door system according to claim 19, wherein the motion detector causes the door opening signal to be sent by transmitting a signal to a controller, which in turn generates the door opening signal to operate the drive system.

21. The door assembly of claim 1, wherein when the first sliding door panel and the second sliding door panel are in the closed position, there is no overlap between the first and second door panels and the fixed door panel.

* * * * *